US006226490B1

(12) United States Patent
Fujita et al.

(10) Patent No.: US 6,226,490 B1
(45) Date of Patent: May 1, 2001

(54) TONER REPLENISHING APPARATUS AND IMAGE FORMING APPARATUS EQUIPPED WITH SAME

(75) Inventors: Syouichi Fujita; Itaru Kawabata, both of Kashiba; Hideji Saiko, Kitakatsuragi-gun; Hirofumi Sakita, Tenri; Masato Asanuma, Nara; Kouichi Takenouchi, Nabari; Yoshiaki Sanada, Ikoma; Yasuyuki Ishiguro, Higashiosaka, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/359,314

(22) Filed: Jul. 23, 1999

(30) Foreign Application Priority Data

Jul. 24, 1998 (JP) ..... 10-209814

(51) Int. Cl.[7] ..... G03G 21/10
(52) U.S. Cl. ..... 399/359
(58) Field of Search ..... 399/120, 253, 399/258, 358–360

(56) References Cited

U.S. PATENT DOCUMENTS 5,493,382 2/1996 Takagaki et al. .
5,499,090 * 3/1996 Ito et al. ..... 399/359
5,737,680 * 4/1998 Takagaki et al. ..... 399/359
5,848,343 * 12/1998 Takahashi et al. ..... 399/359
5,852,757 * 12/1998 Tooda et al. ..... 399/359 X
6,041,212 * 3/2000 Okada ..... 399/359

FOREIGN PATENT DOCUMENTS 59-166264 11/1984 (JP) .
6-110329 4/1994 (JP) .
9-236978 9/1997 (JP) .

* cited by examiner

*Primary Examiner*—William J. Royer

(57) ABSTRACT

To solve problems that the amount of reuse toner increases with time recovery of reuse toner is efficiently achieved while forming an image of high quality. In a toner replenishing apparatus, toner recovered by a cleaning unit is conveyed via conveying device and contained in a recovery toner container. When an amount of the recovery toner exceeds a predetermined capacity of the recovery toner container, the recovery toner flows into a fresh toner container over an upper edge of a partition wall. Fresh toner and recovery toner are replenished to a developing unit via a fresh toner replenishing roller and a recovery toner replenishing roller, respectively, and the ratio between fresh toner and recovery toner is selected so that the fresh toner occupies a larger part than the recovery toner. This ratio is controlled on the basis of the cumulative rotation time of a photoconductor drum counted by a counting device.

16 Claims, 24 Drawing Sheets

TONER REPLENISHING APPARATUS AND IMAGE FORMING APPARATUS EQUIPPED WITH SAME

BACKGROUND OF THE INVENTION

1. Field of the Invention

The present invention relates to a toner replenishing apparatus utilizing an electrophotographic system such as copiers, facsimile machines or printers, and an image forming apparatus equipped with the toner replenishing apparatus, and more specifically, relates to a toner replenishing apparatus capable of recovering toner residue on a photoconductor for reuse in development of an electrostatic latent image to provide a stable image, and to an image forming apparatus equipped with the toner replenishing apparatus.

2. Description of the Related Art

Hitherto an image forming apparatus utilizing a electrophotographic system such as copiers, facsimile machines or printers performs image formation by adhering toner to an electrostatic latent image formed on a photoconductor by developing means to make the image visible, transferring a toner image formed by thus making the image visible to a material subject to transfer such as a sheet of transfer paper and fixing the visible image. In such a process of image forming, while most of the toner adheres to the electrostatic latent image on the photoconductor in transferring to a sheet of transfer paper or the like, part thereof remains on the photoconductor without transferred and is recovered by cleaning means serving as recovering means.

This toner residue on the photoconductor is easy to be adversely affected by environmental conditions. For instance, under conditions of high temperature and high humidity, reduction in transfer efficiency is caused and toner residue on the photoconductor increases. Moreover, a minute amount of toner adhering to the photoconductor in a region where the electrostatic latent image is not formed and remaining on the photoconductor without being transferred is also recovered by the cleaning means. In addition, a visible image of a reference density pattern formed on the photoconductor for the purpose of process control such as control of toner concentration also remains on the photoconductor without being transferred and is recovered by the cleaning means.

On the other hand, in connection with recent environmental problems, it is natural that effective use of resources is increasingly valued even in OA appliances. As for use of toner in image forming apparatuses utilizing the electrophotographic process, it is usual that in the conventional image forming apparatus, about 20% of toner to be used is recovered by the cleaning means without being transferred to a sheet of transfer paper to become waste toner, and discarded as industrial wastes.

In view of the above, such an image forming apparatus as follows is proposed. In order to effectively reuse toner recovered by the cleaning means (referred to as recovery toner hereinafter) by using a toner recycling mechanism, the image forming apparatus is configured so as to convey and replenish recovery toner in the cleaning means to the side of the developing means and reuse the toner as recycled toner, thereby increasing the available volume of image formation as well as eliminating a drudgery of discarding waste toner of the image forming apparatus to reduce inconvenience for the user.

In Japanese Unexamined Utility Model Publication JP-U 59-166264 (1984), it is enabled that from the outlet of a cleaning apparatus for removing toner residue on a photoconductor after transfer, removed toner which is recovery toner is conveyed to a toner replenishing section to which new toner is also conveyed, and thereby the removed toner and the new toner are mixed and replenished to a developer.

Next, in Japanese Unexamined Patent Publication JP-A 9-236978 (1997), although old toner which is recovery toner and new toner are mixed and replenished to a developer as well as in JP-U 59-166264 mentioned above, a method for mixing the old and new toners is notable. That is to say, attention is directed to a problem such that due to toner with unstable characteristics which is generated in the case of recycling toner to repeatedly develop electrostatic latent images, the developed images become unstable and a fog in a white region exceeds a permissible value. Therefore, it is enabled that when the old toner and the new toner are mixed, the mixture ratio between the old and new toners is controlled by a CPU, and as the volume of image formation increases, the ratio of the old toner is reduced.

Next, in Japanese Unexamined Patent Publication JP-A 6-110329 (1994), in order to limit the convey amount in a convey path for conveying recovery toner to the toner replenishing section and the convey amount of toner supplied from the toner replenishing section to the developer, into a given range, the convey amount in the convey path is controlled, a toner replenishing roller is controlled with respect to the developer, a toner temporary container is placed in a recovery toner convey path, a shutter is placed at the outlet of the recovery toner convey path, a container of the recovery toner is placed, and so on. Moreover, it is also enabled that the ratio between the new toner and the recovery toner is regulated based on the concentration of the old toner and the replenishing amounts of the respective toners are controlled based on the developing ability and the result of detecting the density of a reference image for detecting failed toner.

With regard to JP-U 59-166264, there is a problem such that when toner is continuously recycled by the toner recycling mechanism to form images, image density gradually declines during a period of time when the same toner is used. Further, in connection with the declination of image density, there is a problem such that fogs in a white region gradually increases during the period of time when the same toner is used. Furthermore, there is a problem such that as the amount of recycled toner increases in the same toner, the amount of scattered toner increases around a photoconductor. In addition, the recovery toner to be reused deteriorates after undergoing the process of image forming many times to be hardly charged with electricity as a result or to come to contain toner which is charged to the opposite polarity, with the result that the replenishing amount of the recovery toner decreases with time. As a result, such a problem is caused that the amount of the recovery toner in the recovery toner container continuously increases with time, the recovery toner container is filled with the recovery toner in a short time, the recovery toner floods, and the recovery toner agglomerates due to increase of the pressure inside the recovery toner container, with the result that images are chipped because of a failure of supplying the recovery toner and use of a mass of recovery toner in development. Further, there is a problem such that a fog caused by charge-failed toner results in deterioration of the image quality such as a stain. In this case, the fog means that toner transfers to a non-image region in which there is no electrostatic latent image.

In JP-A 9-236978, in order to solve the aforementioned problems, it is enabled that the mixture ratio between the old and new toners is controlled by a CPU, and as the volume of image formation increases, the ratio of the old toner is reduced. However, it is impossible to implement an apparatus at a low cost because a control function by the CPU is necessary in this method, and the overflow of an old toner hopper is not taken into consideration.

Further, in JP-A 6-110329, the mixture ratio between the toners is regulated by controlling the convey amount of the convey path, controlling the toner replenishing roller with respect to the developer, placing the recovery toner container in the recovery toner convey path, placing the shutter at the outlet of the recovery toner convey path, placing the recovery toner container, and the like, so that it is impossible to implement an apparatus at a low cost, and the overflow of a recovery toner container is not taken into consideration.

SUMMARY OF THE INVENTION

It is an object of the invention to provide a toner replenishing apparatus and an image forming apparatus equipped with the same, which toner replenishing apparatus can effectively reuse the recovery toner to form high quality images and solve the problems caused by a fact that the volume of recovery toner increases with time.

The invention provides a toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner recovered by the recovering means to the recovery toner container; and toner replenishing means for replenishing fresh toner supplied from the fresh toner container and recovery toner supplied from the recovery toner container, to the developing means, wherein when an amount of the recovery toner contained in the recovery toner container exceeds a predetermined capacity of the recovery toner container, recovery toner is routed to the fresh toner container instead of the recovery toner container.

According to the invention, toner residue on the photoconductor which has been supplied from the developing means to an electrostatic latent image formed on the photoconductor to develop the electrostatic latent image and has been transferred to a material subject to transfer is recovered by the recovering means, conveyed to the recovery toner container by the conveying means and contained in the recovery toner container. The recovery toner contained in the recovery toner container is replenished to the developing means by the toner replenishing means and mixed with the fresh toner replenished to the developing means by the toner replenishing means. After that, the mixed toner is used in development of an electrostatic latent image. In this way, recycling of toner is conducted.

An image is formed by conducting the recycling of toner, and as the volume of image formation increases, the amount of the recovery toner increases and may exceed the predetermined capacity of the recovery toner container. In this case, recovery toner is routed to the fresh toner container instead of the recovery toner container, so that an undesirable pressure does not act on the recovery toner contained in the recovery toner container, and hence it is possible to prevent the quality of toner from being deteriorated due to agglomeration of the recovery toner and prevent the recovery toner from permanently remaining in the recovery toner container.

Further, the toner replenishing apparatus of the invention is characterized in that the recovery toner exceeding the predetermined capacity of the recovery toner container flows into the fresh toner container over an upper edge of a partition wall dividing the fresh toner container and the recovery toner container, to be contained therein.

According to the invention, when the amount of the recovery toner contained in the recovery toner container exceeds the predetermined capacity, the recovery toner exceeding the predetermined capacity flows into the fresh toner container over the upper edge of the partition wall, to be contained therein, so that it is possible to change the supply path for the recovery toner with a simple configuration and simplify the configuration of the apparatus.

Still further, the toner replenishing apparatus of the invention is characterized in that:

the conveying means includes first conveying means for conveying the recovery toner recovered by the recovering means to the recovery toner container, and second conveying means for conveying the recovery toner conveyed by the first conveying means to the fresh toner container, the second conveying means extending between the recovery toner container and the fresh toner container;

the recovery toner container is provided with capacity excess detecting means for detecting that an amount of the recovery toner contained in the recovery toner container exceeds the predetermined capacity; and when it is detected by the capacity excess detecting means that the amount of the recovery toner exceeds the predetermined capacity, the recovery toner conveyed by the first conveying means is conveyed to the fresh toner container via the second conveying means.

According to the invention, when the amount of the recovery toner is equal to or less than the predetermined capacity of the recovery toner container, the recovery toner is supplied to and contained in the recovery toner container from the recovering means via the first conveying means. When it is detected by the capacity excess detecting means that the amount of the recovery toner exceeds the predetermined capacity, the recovery toner conveyed by the first conveying means is conveyed to the fresh toner container via the second conveying means. As a result, recovery toner is routed to the fresh toner container instead of the recovery toner container, and the recovery toner is fed into the fresh toner container from the recovering means via the first and second conveying means.

When it is detected by the capacity excess detecting means that the amount of the recovery toner exceeds the predetermined capacity, the recovery toner conveyed by the first conveying means is conveyed to the fresh toner container via the second conveying means, so that it is possible to implement a toner replenishing apparatus with operability which does not require the user to conduct the confirmation of the condition of the recovery toner container and the like and does not cause the overflow of the recovery toner due to negligence of the user.

Still further, the invention provides a toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein the fresh toner container and the recovery toner container are partitioned by a partition wall, at a lower edge of which the recovery toner flows into the fresh toner container from the recovery toner container.

According to the invention, the recovery toner is supplied to and contained in the recovery toner container from the recovering means via the conveying means. The recovery toner contained in the recovery toner container flows into the fresh toner container from the recovery toner container at the lower edge of the partition wall. After that, the fresh toner and the recovery toner are replenished to the developing means by the toner replenishing means while being mixed with each other, and used again in development of an electrostatic latent image. In this way, recycling of toner is conducted.

Since the recovery toner flows into the fresh toner container from the recovery toner container at the lower edge of the partition wall, it is possible to replenish the fresh toner and the recovery toner to the developing means after the toners are completely mixed with each other, and hence it is possible to prevent abrupt deterioration of the image quality, which occurs when only the recovery toner is replenished to the developing means. In addition, the recovery toner is surely used in image forming, and hence the utilizing factor of toner can be enhanced.

Still further, the toner replenishing apparatus of the invention is characterized in that a toner counterflow preventing member for preventing the counterflow of the fresh toner into the recovery toner container is provided at the lower edge of the partition wall.

According to the invention, the counterflow of the fresh toner into the recovery toner container is prevented by the toner counterflow preventing member, so that it is possible to prevent the bottom of the recovery toner container from being closed by the fresh toner and prevent a load for replenishing toner to the developing means from increasing. Moreover, the recovery toner is not mixed with the fresh toner unless discharged via the toner counterflow preventing member, so that it is possible to avoid only one of the fresh toner and the recovery toner from being replenished. That is to say, the fresh toner does not flow into the recovery toner container to hinder the recovery toner from being discharged, so that it is possible to prevent that only the fresh toner is replenished to the developing means at first and thereafter the recovery toner is concentratedly replenished from the recovery toner container to the developing means to thereby cause abrupt deterioration of the image quality.

Still further, the toner replenishing apparatus of the invention is characterized in that the toner counterflow preventing member is made of a flexible elastic material.

According to the invention, the toner counterflow preventing member is made of a flexible elastic material, so that when the amount of the recovery toner reserved in the vicinity of a region where the bottom of the recovery toner container makes contact with the lower edge of the toner counterflow preventing member, reaches an amount enough to displace the toner counterflow preventing member to the side of the fresh toner container, the recovery toner pushes the toner counterflow preventing member to the side of the fresh toner container and flows into the fresh toner container. When the recovery toner flows into the fresh toner container and thereby the amount of the toner is reduced, the toner counterflow preventing member returns to its original position due to elasticity thereof. As a result, the fresh toner container and the recovery toner container are intercepted by the toner counterflow preventing member, whereby it is possible to prevent the fresh toner from flowing counterflowly to the recovery toner container.

Further, the toner counterflow preventing member is preferably a material lacking an affinity for toner. Using such a material, it is possible to prevent toner from adhering to the toner counterflow preventing member and prevent the toner counterflow preventing member from reacting with the component of the toner to alter the quality thereof. As a result, it is also possible to avoid the quality of the toner counterflow preventing member from being altered by the component of the toner because of changes with time. Therefore, it is possible to maintain the function of preventing the counterflow of toner for a long period of time.

Still further, the toner replenishing apparatus of the invention is characterized in that the recovery toner container is provided with a reservoir for temporarily reserving the recovery toner.

According to the invention, after temporarily reserved in the reservoir, the recovery toner conveyed by the conveying means is supplied to the fresh toner container via the toner counterflow preventing member to be mixed therein. In this way, the recovery toner is temporarily reserved in the reservoir before mixed with the fresh toner and thereafter mixed with the fresh toner, so that the recovery toner which has been heated in image forming can be reused after ample time, and can be reused in image forming after the quality of the recovery toner for image forming is enhanced by dissipating heat of the recovery toner during the ample time. Therefore, it is possible to avoid in advance that the recovery toner with lowered characteristics which is set aside for a long time forms a mass in the recovery toner container and deteriorates the image quality when used in image forming.

Still further, the invention provides a toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein when an amount of the recovery toner contained in the recovery toner container exceeds a predetermined capacity of the recovery toner container, recovery toner is routed to the fresh toner container instead of the recovery toner container;

the toner replenishing means is disposed at a bottom of a toner container which is integrally formed by the fresh toner container and the recovery toner; and at the bottom of the toner container, a plurality of first toner supply orifices, open toward the toner replenishing means to supply the fresh toner to the toner replenishing means, and a plurality of second toner supply orifices, open toward the toner replenishing means to supply the recovery toner to the toner replenishing means, are alternately arranged.

According to the invention, the plurality of first toner supply orifices and the plurality of second toner supply orifices are alternately arranged at the bottom of the toner container. Each of the first and second toner supply orifices is open, facing the single toner replenishing means. The fresh toner is supplied from each of the first toner supply orifices to the toner replenishing means, and the recovery toner is supplied from each of the second toner supply orifices to the toner replenishing means. In this way, the plurality of first and second supply orifices are alternately arranged, and each of the first and second toner supply orifices is open, facing the single toner replenishing means, so that it is possible to supply the fresh toner and the recovery toner to the single toner replenishing means, and hence it is not necessary to separately provide means for replenishing the fresh toner to the developing means and means for replenishing the recovery toner to the developing means. Therefore, it is possible to simplify the configuration of the apparatus and reduce the manufacturing cost.

Still further, the toner replenishing apparatus of the invention is characterized in that an opening area of each first toner supply orifice is larger than an opening area of each second toner supply orifice.

According to the invention, the opening area of each of the first toner supply orifices is larger than the opening area of each of the second toner supply orifices, so that it is possible to make the ratio of the fresh toner more than the ratio of the fresh toner in the toner supplied to the replenishing means. As a result, it is possible to readily increase the ratio of the fresh toner in the toner replenished from the toner replenishing means to the developing means.

Moreover, it is preferable that the sum of the opening areas of the first toner supply orifices is larger than the sum of the opening areas of the second toner supply orifices. Also in this way, regardless of the opening areas of each of the first and second toner supply orifices, it is possible to make the ratio of the fresh toner higher than the ratio of the recovery toner in the toner supplied to the toner replenishing means.

Still further, the toner replenishing apparatus of the invention is characterized in that with respect to an amount of toner to be replenished to the developing means by the toner replenishing means, an amount of the toner replenished by the toner replenishing means in regions corresponding to the respective first supply orifices is more than an amount of the toner replenished by the toner replenishing means in regions corresponding to the respective second toner supply orifices.

According to the invention, the fresh toner supplied from each of the first toner supply orifices is replenished to the developing means by the toner replenishing means in the regions corresponding to the respective first toner supply orifices. The recovery toner supplied from each of the second toner supply orifices is replenished to the developing means by the toner replenishing means in the regions corresponding to the respective second toner supply orifices. With respect to the amount of the toner to be replenished from the toner replenishing means to the developing means, the amount of the toner replenished from the toner replenishing means in the region corresponding to each first supply orifice is larger than the amount of the toner replenished from the toner replenishing means in the region corresponding to each second toner supply orifice. Therefore, it is possible to make the ratio of the fresh toner higher than the ratio of the recovery toner in the toner inside the developing means, and it is possible to prevent the image density from being decreased and the image quality from being degraded. Further, the regions corresponding to the respective first toner supply orifices and the regions corresponding to the respective second toner supply orifices are alternately arranged in the toner replenishing means, so that the toner of each orifice is supplied to the developing means in the state of being arranged alternatively, the toner of each orifice is uniformly mixed in the developing means. Therefore, it is possible to prevent the fresh toner and the recovery toner from being localized, and avoid decrease of the image density and degradation of the image quality.

Still further, the invention provides a toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein the fresh toner container and the recovery toner container are partitioned by a partition wall, at a lower edge of which the recovery toner flows into the fresh toner container from the recovery toner container;

the recovery toner is supplied to nearly the center of the recovery toner container;

the recovery toner container, which is of a longitudinal shape, is provided with a tilt member having two slopes, the slopes being inclined downwardly from the center of the recovery toner container to both ends in the longitudinal direction; and the tilt member is provided with a plurality of through holes.

According to the invention, the recovery toner supplied to nearly the center of the recovery toner container drops via the plurality of through holes while sliding down on each of the slopes of the tilt member, almost uniformly deposits on the bottom of the recovery toner container and flows into the fresh toner container. After that, the fresh toner and the recovery toner are replenished to the developing means by the toner replenishing means. In this way, the recovery toner almost uniformly deposits on the bottom of the recovery toner container via the tilt member and flows into the fresh toner container, with the result that the recovery toner in the toner to be replenished to the developing means almost uniformly distributes in the longitudinal direction, and defects of images hardly appears even when the recovery toner with lowered characteristics is used. Therefore, it is possible to avoid deterioration of the image quality with a simple configuration.

Further, a tilt angle of each slope of the tilt member is preferably selected in accordance with the physical properties of the recovery toner. In other words, the tilt angle is preferably selected, for example, in relation to an angle of repose of the recovery toner. By thus selecting the tilt angle, the recovery toner can reliably slide down on each slope without depositing on the slopes.

Furthermore, it is preferable that a project ion which projects upward is disposed to both the longitudinal edges of the tilt member. By disposing the projections, it is possible to prevent the recovery toner which slides down on each slope and reaches both the longitudinal edges from being localized and depositing on both the longitudinal edges of the bottom of the recovery toner container. Accordingly, the ratio of the recovery toner in the toner inside the developing means is to distribute almost uniformly along the longitudinal direction, with the result that it is possible to avoid, for example, the toner from scattering and the image from temporarily blurring.

In addition, with regard to the tilt member, it is preferable that the opening ratio, the distribution density of the through holes, the moving speed of the recovery toner and the opening area of each through hole are different for every region in the direction in which the toner slides down. As a result, it is possible to control the amount of fall of the recovery toner via the tilt member, and almost uniformly supply the recovery toner in the longitudinal direction of the toner replenishing means.

Still further, the invention provides an image forming apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner contained in the fresh toner container and recovery toner contained in the recovery toner container, to the developing means at a predetermined ratio, wherein when an amount of the recovery toner contained in the recovery toner container exceeds a predetermined capacity, recovery toner is routed to the fresh toner container instead of the recovery toner container; and an operation of the conveying means is controlled so as to regulate an amount of the recovery toner which is recovered by the recovering means.

According to the invention, the toner residue on the photoconductor after transfer of the electrostatic latent image formed on the photoconductor, which is supplied from the developing means to the electrostatic latent image, is recovered by the recovering means and conveyed to the recovery toner container by the conveying means. The operation of the conveying means is controlled in order to regulate the amount of the recovery toner. Accordingly the amount of the recovery toner supplied to the toner replenishing means is changed, and the ratio of the recovery toner to the toner to be replenished to the developing means is changed. For example, in the case where the amount of the toner supplied to the recovery toner container is reduced, the amount of the recovery toner supplied to the toner replenishing means is reduced and the ratio of the fresh toner to the toner to be replenished is increased. The toner replenished to the developing means is mixed and reused in development of an electrostatic latent image again. In this way, image forming is performed while toner is recycled.

Since the amount of the recovery toner which is recovered by the recovering means is regulated and the amount of the recovery toner supplied to the toner replenishing means is controlled, it is possible to change the ratio of the recovery toner in the toner to be replenished to the developing means, and it is possible to finely regulate the ratio between the fresh toner and the recovery toner which are replenished to the developing means. Therefore, even when the image quality is deteriorated due to change of an environment using the toner, it is possible to readily develop an image with high quality. Further, even when the amount of the recovery toner contained in the recovery toner exceeds the predetermined capacity, the recovery toner exceeding the predetermined capacity is contained in the fresh toner container, so that an undesirable pressure does not act on the recovery toner contained in the recovery toner container, and hence it is possible to prevent the quality of the recovery toner from being deteriorated due to agglomeration of the recovery toner and prevent the recovery toner from permanently remaining in the recovery toner container.

Still further, the invention provides an image forming apparatus comprising:

developing means for supplying toner to an electrostatic latent image formed on a cylindrical photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container;

toner replenishing means for replenishing fresh toner contained in the fresh toner container and recovery toner contained in the recovery toner container, to the developing means at a predetermined ratio; and counting means for counting any one of a cumulative rotation time of the photoconductor, a cumulative number of rotations of the photoconductor and a volume of image formation, wherein when an amount of the recovery toner contained in the recovery toner container exceeds a predetermined capacity, recovery toner is routed to the fresh toner container instead of the recovery toner container; and on the basis of a counting result of the counting means, operations of the conveying means and the toner replenishing means are controlled so as to change an amount of the toner to be replenished from the toner replenishing means to the developing means.

According to the invention, the toner supplied from the developing means to the electrostatic latent image formed on the photoconductor to remain on the photoconductor after transfer is recovered by the recovering means and conveyed to the recovery toner container by the conveying means, to be contained therein. The recovery toner contained in the recovery toner container is replenished to the developing means by the replenishing means, together with the fresh toner. At this moment, the operations of the conveying means and the toner replenishing means are controlled on the basis of the counting result of the counting means. As a result, the amounts of the fresh toner and the recovery toner which are supplied to the developing means are respectively changed, the amount of the toner to be replenished to the developing means is changed, and the ratio between the fresh toner and the recovery toner to be replenished to the developing means is changed. The toner replenished to the developing means is mixed and reused in development of an electrostatic latent image again. While toner is recycled in this way, image forming is performed.

Since the operations of the conveying means and the toner replenishing means are controlled on the basis of the counting result of the counting means, it is possible to change the amount of the toner to be replenished from the toner replenishing means to the developing means and the ratio between the fresh toner and the recovery toner in the toner, depending on the difference between the fresh toner and the recovery toner in the adhesion characteristic to the toner replenishing means, as well as it is possible to change the ratio of the recovery toner in the toner supplied to the toner replenishing means by regulating the amount of the recovery toner supplied to the recovery toner container to thereby change the amount of the recovery toner supplied to the toner replenishing means. Accordingly, even when the quality of the recovery toner is deteriorated by repeatedly using the recovery toner in development of an electrostatic latent image, it is possible to increase the ratio of the fresh toner to thereby prevent decrease of the image density and deterioration of the image quality.

Still further, the invention provides an image forming apparatus comprising:

- developing means for supplying toner to an electrostatic latent image formed on a cylindrical photoconductor and developing the electrostatic latent image;
- toner concentration detecting means for detecting a concentration of toner in the developing means;
- a fresh toner container for containing fresh toner;
- recovering means for recovering toner residue on the photoconductor;
- a recovery toner container for containing recovery toner which is recovered by the recovering means;
- conveying means for conveying the recovery toner which is recovered by the recovering means to the recovery toner container;
- toner replenishing means for replenishing fresh toner contained in the fresh toner container and recovery toner contained in the recovery toner container, to the developing means at a predetermined ratio; and
- counting means for counting any one of a cumulative rotation time of the photoconductor, a cumulative number of rotations of the photoconductor and a volume of image formation,
  - wherein when an amount of the recovery toner contained in the recovery toner container exceeds a predetermined capacity, recovery toner is routed to the fresh toner container instead of the recovery toner container; and
  - when toner is replenished on the basis of an output of the toner concentration detecting means, operations of the conveying means and the toner replenishing means are controlled so that an amount of toner to be replenished from the toner replenishing means to the developing means is relatively increased as compared with an amount of toner supplied from the conveying means to the toner replenishing means, in accordance with a counting result of the counting means.

According to the invention, the toner supplied from the developing means to the electrostatic latent image formed on the photoconductor to remain on the photoconductor after transfer is recovered by the recovering means and conveyed to the recovery toner container by the conveying means to be contained therein. The recovery toner contained in the recovery toner container is replenished to the developing means by the toner replenishing means, together with the fresh toner. When the concentration of the toner in the developing means changes, the output of the toner concentration detecting means changes. When the output of the toner concentration detecting means changes, the operations of the conveying means and the toner replenishing means are controlled so that the amount of the toner to be replenished from the toner replenishing means to the developing means is relatively increased as compared with the amount of the toner supplied from the conveying means to the toner replenishing means, in accordance with a counting result of the counting means. When the concentration of the toner decreases, for example, the amount of the toner to be replenished from the toner replenishing means to the developing means is increased and the amount of the recovery toner supplied from the conveying means to the toner replenishing means is reduced, in accordance with the counting result of the counting means. Consequently, the ratio of the fresh toner in the toner to be replenished to the developing means is raised. The toner replenished to the developing means is mixed and reused in development of an electrostatic latent image again. While toner is recycled in this way, image forming is conducted.

When toner is replenished on the basis of the output of the toner concentration detecting means, the operations of the conveying means and the toner replenishing means are controlled so that the amount of the toner to be replenished from the toner replenishing means to the developing means is relatively increased as compared with the amount of the toner supplied from the conveying means to the toner replenishing means in accordance with the counting result of the counting means, with the result that it is possible to control the replenishing amounts of the fresh toner and the recovery toner as well as control the ratio of the fresh toner in toner to be replenished. Therefore, even when the image quality is degraded because of deterioration of the quality of the recovery toner and decrease of the concentration of the toner which are caused by repeatedly using the recovery toner in development of an electrostatic latent image, it is possible by raising the concentration of the toner and the ratio of the fresh toner to prevent the density of an image from being decreased and the image quality from being deteriorated.

Still further, the invention provides an image forming apparatus comprising:

- developing means for supplying toner to an electrostatic latent image formed on a photoconductor and developing the electrostatic latent image;
- a fresh toner container for containing fresh toner;
- recovering means for recovering toner residue on the photoconductor;
- a recovery toner container for containing recovery toner which is recovered by the recovering means;
- conveying means for conveying the recovery toner which is recovered by the recovering means to the recovery toner container; and
- toner replenishing means for replenishing fresh toner supplied from the fresh toner container and recovery toner supplied from the recovery toner container, to the developing means, wherein the fresh toner container and the recovery toner container are partitioned by a partition wall, at a lower edge of which the recovery toner flows into the fresh toner container from the recovery toner container;

the recovery toner is supplied to nearly the center of the recovery toner container;

the recovery toner container, which is of a longitudinal shape, is provided with a tilt member having two slopes, the slopes being inclined downwardly from the center of the recovery toner container to both edges in the longitudinal direction;

the tilt member is provided with a plurality of through holes;

the developing means is provided with toner concentration detecting means for detecting a concentration of toner inside thereof; and a ratio of recovery toner in the toner to be replenished to the developing means is set to be equal to or less than a ratio which can be detected by the toner concentration detecting means.

According to the invention, the recovery toner recovered by the recovering means and supplied to nearly the center of the recovery toner container by the conveying means slides down on each slope of the tilt member to drop via the respective through holes, and almost uniformly deposits on the bottom of the recovery toner container to flow into the fresh toner container. The fresh toner and the recovery toner are replenished to the developing means by the toner replenishing means. The toner replenished to the developing means is mixed within the developing means, the concentration thereof is detected by the toner concentration detecting means, and the ratio of the recovery toner in the toner to be replenished to the developing means is set to be equal to or less than a ratio which can be detected by the toner concentration detecting means. After that, the mixed toner is used in development of an electrostatic latent image again.

Since the developing means is provided with the toner concentration detecting means, it is possible to control the ratio of the fresh toner in the mixed toner to be replenished to the developing means, and hence it is possible to suppress adverse effects resulting from the characteristics of the recovery toner which is deteriorated as being reused, thereby implementing an image forming apparatus with high accuracy. In view of the utilizing factor of toner, it is preferable to mix the recovery toner as much as possible within a range not to affect the image quality. However, as the ratio of toner with deteriorated characteristics which is repeatedly used in the development operation, the toner concentration detecting means may come to output in an unstable manner to become incapable of following the change of characteristics of the toner, and it may get difficult to control the concentration of the toner. Therefore, the recovery toner is mixed the most within a range which the toner concentration detecting means can recognize as a predetermined range of characteristics of toner, thereby eliminating the necessity of correcting the output of the toner concentration detecting means.

Still further, the invention provides an image forming apparatus comprising:

developing means for supplying toner to an electrostatic latent image formed on a cylindrical photoconductor and developing the electrostatic latent image;

a fresh toner container for containing fresh toner;

recovering means for recovering toner residue on the photoconductor;

a recovery toner container for containing recovery toner which is recovered by the recovering means;

recovery toner conveying means for conveying the recovery toner which is recovered by the recovering means to the recovery toner container;

waste toner conveying means for conveying recovery toner to a waste toner container in which the recovery toner which is recovered by the recovering means is to be discarded and contained;

toner replenishing means for replenishing fresh toner supplied from the fresh toner container and recovery toner supplied from the recovery toner container, to the developing means; and counting means for counting any one of a cumulative rotation time of the photoconductor, a cumulative number of rotations of the photoconductor and a volume of image formation, wherein on the basis of a counting result of the counting means, operations of the recovery toner conveying means and the waste toner conveying means are controlled so as to regulate an amount of toner to be conveyed to the recovery toner container and an amount of toner to be conveyed to the waste toner container.

According to the invention, the toner which remains on the photoconductor after developing an electrostatic latent image and being transferred is recovered by the recovering means. The recovery toner having been recovered is conveyed to the recovery toner container and the waste toner container by the recovery toner conveying means and the waste toner conveying means, after the amount of the toner conveyed to the recovery toner container and the amount of the toner conveyed to the waste toner container are regulated on the basis of the counting result of the counting means. That is to say, in accordance with increase of the counting result, the amount of the waste toner is increased and the amount of the recovery toner to be conveyed to the recovery toner container is decreased. After that, the recovery toner contained in the recovery toner container and the fresh toner are replenished to the developing means by the toner replenishing means and mixed with each other, thereby used in development of an electrostatic latent image again.

Based on the counting result of the counting means, the amount of the toner conveyed to the recovery toner container and the amount of the toner conveyed to the waste toner container are regulated within the recovering means, so that it is possible to avoid the overflow of the recovery toner container and suppress adverse effects of the characteristics of the recovery toner deteriorated by automatically discarding the recovery toner which is deteriorated as being reused and cannot be reused any more, thereby implementing an image forming apparatus with high accuracy. In other words, since the ratio of the deteriorated toner contained in the recovery toner gradually increases as the counting result increases, it is possible to stabilize the image quality by increasing the amount of the recovery toner to be discarded and decreasing the amount of the recovery toner to be conveyed to the recovery toner container.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
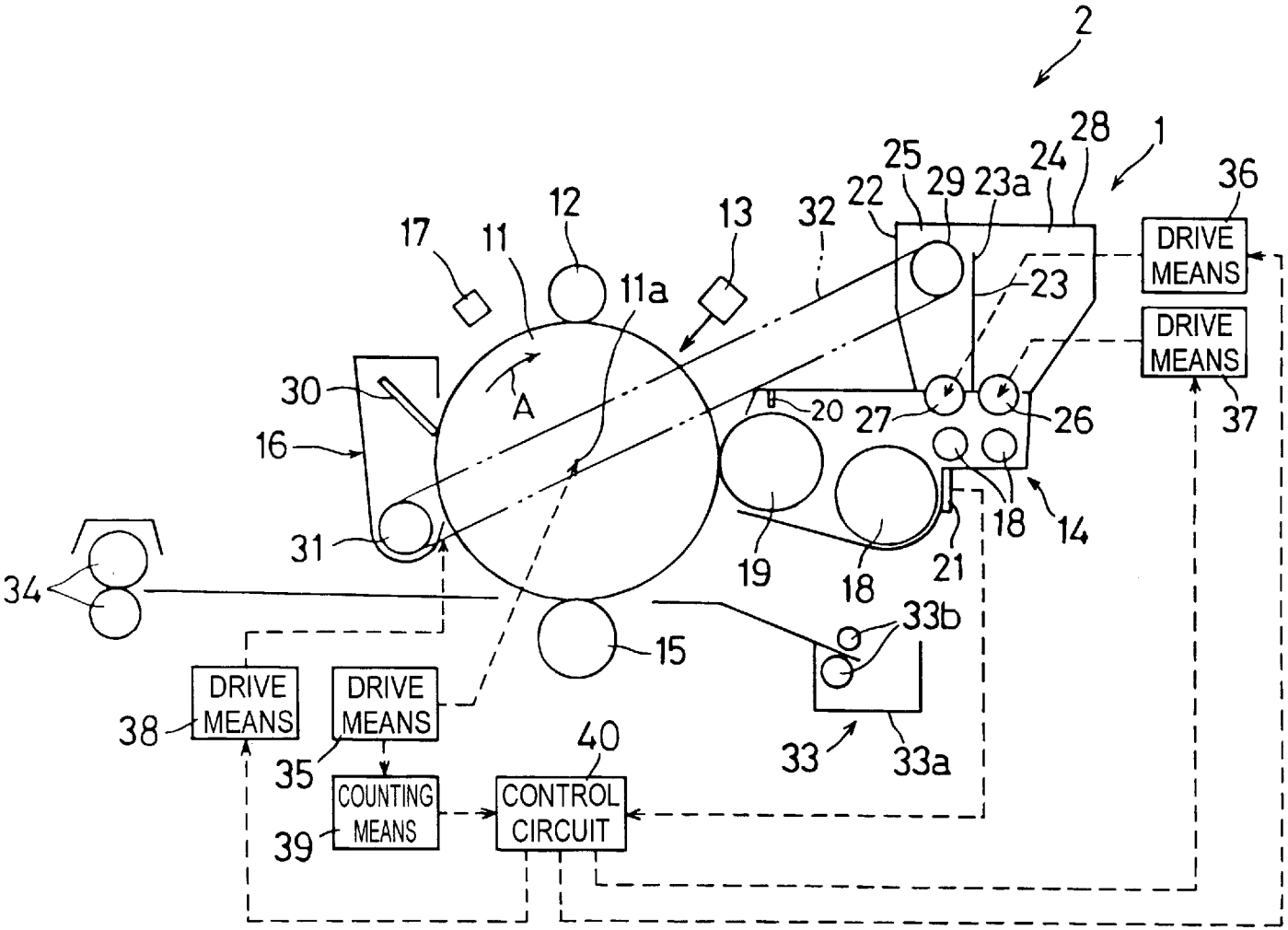
FIG. 1 is a sectional view showing a simplified configuration of an image forming apparatus equipped with a toner replenishing apparatus of an embodiment of the invention.

Now referring to the drawings, preferred embodiments of the invention are described below.

FIG. 1 is a sectional view showing a simplified configuration of an image forming apparatus 2 equipped with a toner replenishing apparatus 1 of an embodiment of the invention. The image forming apparatus 2 comprises a photoconductor drum 11, a charge unit 12, an exposing unit 13, a developing unit 14 serving as developing means, a transfer unit 15, a cleaning unit 16 serving as recovering means and a charge-eliminating unit 17. The photoconductor drum 11 is a photoconductor formed into a cylindrical shape, being disposed so as to be capable of rotating around a rotation axis 11*a* which is perpendicular to the surface of a paper sheet of FIG. 1. Above the photoconductor drum 11, the charge unit 12 for uniformly charging the peripheral surface of the photoconductor drum 11 is disposed so as to be close to and opposed to the peripheral surface. Downstream from the charge unit 12 in the rotation direction A of the photoconductor drum 11, the exposing unit 13 for exposing the photoconductor drum 11 and forming an electrostatic latent image is disposed so as to be close to and opposed to the peripheral surface of the photoconductor drum 11. Downstream from the exposing unit 13 in the rotation direction A of the photoconductor drum 11, the developing unit 14 is disposed, the developing unit supplying toner to an electrostatic latent image formed on the photoconductor drum 11 and developing the electrostatic latent image. Downstream from the developing unit 14 in the rotation direction A of the photoconductor drum 11, the transfer unit 15 is disposed, the transfer unit transferring a developed toner image to a sheet of paper which is a transfer material. Downstream from the transfer unit 15 in the rotation direction A of the photoconductor drum 11, the cleaning unit 16 is disposed, the cleaning unit recovering toner which remains on the photoconductor drum 11 without being transferred to the sheet of paper. Downstream from the cleaning unit 16 in the rotation direction A of the photoconductor drum 11, the charge-eliminating unit 17 for eliminating the charge on the photoconductor drum 11 is disposed.

As the exposing unit 13, a semiconductor laser, an LED array, a liquid crystal shutter array or the like is used. In this embodiment of the invention, a developer is a two-component developer which is composed of non-magnetic toner and carrier formed of a magnetic material. Hereinafter, the developer is simply referred to toner as a generic name. The developing unit 14 is provided with agitating rollers 18, a magnet roller 19, a doctor blade 20 and a T sensor 21 serving as toner concentration detecting means. The agitating rollers 18 agitate and mix toner contained in the developing unit 14. The magnet roller 19 carries toner on the peripheral surface thereof by a magnetic force. The doctor blade 20 limits and controls the toner on the magnet roller 19 to a necessary amount. The T sensor 21, which adopts a magnetic permeability system, detects the concentration of the toner in the developing unit 14.

Above the developing unit 14, a toner hopper 22 serving as a toner container for containing toner is disposed. The toner hopper 22 has a length which is almost equal to the length of the photoconductor drum 11 in the rotation axis, being formed into a long shape. As for the toner hopper 22, the inside space thereof is divided into a fresh toner container 24 for containing fresh toner and a recovery toner container 25 for containing recovery toner recovered by the cleaning unit 16, by a partition wall 23 perpendicularly erecting from the bottom of the toner hopper 22. The partition wall 23 is disposed so that the upper edge 23*a* thereof is spaced from a top plate 28 closing the upper end of the toner hopper 22. Therefore, the fresh toner container 24 and the recovery toner container 25 lead to each other above the partition wall 23. At the bottom of the toner hopper 22, a fresh toner replenishing roller 26 for replenishing the fresh toner contained in the fresh toner container 24 to the developing unit 14 and a recovery toner replenishing roller 27 for replenishing the recovery toner contained in the recovery toner container 25 to the developing unit 14 are disposed.

The cleaning unit 16 includes a blade 30 for scraping the toner residue on the photoconductor drum 11 and discharging means 31 for recovering the toner scraped by the blade 30 and conveying the toner to the outlet of the cleaning unit 16, the discharging means being formed of, for example, a screw conveyor. Between the cleaning unit 16 and the recovery toner container 25 of the toner hopper 22, conveying means 32 for conveying the recovery toner discharged by the discharging means 31 to the recovery toner container 25 is disposed, the conveying means being formed of, for example, a screw conveyor.

The photoconductor drum 11 is rotatably driven by drive means 35 for driving the photoconductor drum which includes an electric motor or the like. The fresh toner replenishing roller 26 is rotatably driven by drive means 36 for driving the fresh toner replenishing roller which includes an electric motor or the like. The recovery toner replenishing roller 27 is rotatably driven by drive means 37 for driving the recovery toner replenishing roller which includes an electric motor or the like. The conveying means 32 is rotatably driven by screw drive means 38 which includes an electric motor or the like. Counting means 39 counts the cumulative rotation time of the photoconductor drum 11 through the electric motor of the photoconductor drum drive means 35. A control circuit 40, which is implemented by a central processing unit (CPU), controls the operations of the photoconductor drum drive means 35, the fresh toner replenishing roller drive means 36, the recovery toner replenishing roller drive means 37 and the screw drive means 38, on the basis of the outputs of the T sensor 21 and the counting means 39.

The fresh toner replenishing roller 26 and the recovery toner replenishing roller 27 are formed by fitting a cylindrical member made of a porous elastic material such as sponge to a rotation axis made of metal having stiffness. The respective toner replenishing rollers 26 and 27 rotate around the axes thereof, whereby the fresh toner and the recovery toner adhere onto the peripheral surfaces of the respective toner replenishing rollers 26 and 27, and is replenished to the developing unit 14, respectively.

The toner replenishing apparatus 1 includes the developing unit 14, the toner hopper 22, the cleaning unit 16, the conveying means 32, the photoconductor drum drive means 35, the fresh toner replenishing roller drive means 36, the recovery toner replenishing roller driving means 37, the screw drive means 38, the counting means 39 and the control circuit 40.

The operation of the image forming apparatus 2 which is thus configured will be described. When forming an image, the photoconductor drum 11 is rotatably driven around the rotation axis 11*a* in the rotation direction A by the photoconductor drum drive means 35. As for this photoconductor drum 11, the peripheral surface of the photoconductor drum 11 is uniformly charged by the charge unit 12, an original image is exposed to the photoconductor drum 11 by the exposing unit 13, and an electrostatic latent image of the original image is thereby formed. When part of the photoconductor drum 11 on which the electrostatic latent image is formed reaches a position of the developing unit 14, toner is supplied to the electrostatic latent image by the developing unit, and the electrostatic latent image is developed and made into a toner image.

When the position of the developed toner image reaches the transfer unit 15, a sheet of paper contained in a feeding cassette 33*a* of feeding means 33 is supplied by a feeding roller 33*b* in synchronization with the photoconductor drum 11, and the toner image on the photoconductor drum 11 is transferred onto the sheet of paper by the transfer unit 15. To the sheet of paper onto which the toner image is thus transferred, a fixing process of heating and pressurizing the toner image is given by a fixing unit 34 composed of a pair of rollers, whereby image forming to the sheet of paper is finished. On the other hand, the toner residue on the photoconductor drum 11 after transfer is scraped and removed by the blade 30 of the cleaning unit 16. The removed toner is recovered by the discharging means 31 of the cleaning unit 16. The toner recovered by the discharging means 31 is discharged to the conveying means 32 by the discharging means 31, conveyed to a recovery toner bringing path 29 by the conveying means 32, and supplied from the recovery toner bringing path 29 to the recovery toner container 25 of the toner hopper 22, to be contained therein.

In this way, the fresh toner contained in the fresh toner container 24 and the recovery toner contained in the recovery toner container 25 are replenished to the developing unit 14 at a predetermined ratio by the fresh toner replenishing roller 26 and the recovery toner replenishing roller 27. The fresh toner and the recovery toner replenished to the developing unit 14 are agitated and mixed by the agitating rollers 18. This mixed toner is used in development of an electrostatic latent image again.

As the volume of image formation increases, the amount of the recovery toner increases, and the amount of the recovery toner contained in the recovery toner container 25 may exceed a predetermined capacity of the recovery toner container 25. When the amount of the recovery toner exceeds the predetermined capacity of the recovery toner container 25, the recovery toner exceeding the predetermined capacity flows into the fresh toner container 24 over the upper edge 23*a* of the partition wall 23, to be contained therein. That is to say, the route of the recovery toner is changed over from the recovery toner container 25 to the fresh toner container 24.

In this way, the route of the recovery toner is changed over from the recovery toner container 25 to the fresh toner container 24, so that an undesirable pressure does not act on the recovery toner contained in the recovery toner container 25, and hence it is possible to prevent the quality of the toner from being deteriorated and the recovery toner from permanently remaining in the recovery toner container 25 due to agglomeration of the recovery toner. Moreover, the recovery toner exceeding the predetermined capacity flows into the fresh toner container 24 over the upper edge of the partition wall 23, to be contained therein, so that it is possible to change over the route of the recovery toner with a simple configuration and it is possible to simplify the configuration of the apparatus.

Further, as the volume of image formation increases, the control circuit 40 controls the number of rotations or the rotation time of the screw drive means 38 based on the counting result of the counting means 39 and regulates the amount of the recovery toner which is supplied to the recovery toner container by the conveying means 32. As a result, the amount of the recovery toner supplied to the recovery toner replenishing roller 27 is varied, and the ratio of the recovery toner in the toner supplied to the developing means is varied. For example, when the amount of the toner supplied to the recovery toner container 25 is reduced, the amount of the recovery toner supplied to the recovery toner replenishing roller 27 is decreased and the ratio of the fresh toner in the toner to be replenished is increased.

Further, on the basis of the counting result of the counting means 39, the control circuit 40 separately controls the numbers of rotations or the rotation times of the fresh toner replenishing roller drive means 36 and the recovery toner replenishing roller drive means 37, and changes the amount of the fresh toner supplied to the developing unit 14 and the amount of the recovery toner to be replenished to the developing unit 14. As a result, the ratio between the fresh toner and the recovery toner to be replenished to the developing means is changed. When the concentration of the toner varies in the developing unit 14, the output of the T sensor 21 varies, and in accordance with the counting result of the counting means 39, the control circuit 40 controls the operations of the conveying means 32 and the respective toner replenishing rollers 26 and 27 so that the amount of the toner to be replenished from the each of the toner replenishing rollers 26 and 27 to the developing unit 14 is relatively increased as compared with the amount of the toner supplied from the conveying means 32 to the recovery toner replenishing roller 27. For example, when the concentration of the toner is decreased, the amount of the toner to be replenished from each of the toner replenishing rollers 26 and 27 to the developing unit 14 is increased and the amount of the recovery toner supplied from the conveying means 32 to the recovery toner replenishing roller 27 is decreased in accordance with the counting result of the counting means 39. As a result, the ratio of the fresh toner is increased in the toner to be replenished to the developing unit 14.

In this way, the amount of the recovery toner recovered by the cleaning unit 16 is regulated and the amount of the recovery toner supplied to the recovery toner replenishing roller 27 is controlled, so that it is possible to change the ratio of the recovery toner in the toner supplied to the developing unit 14 and it is possible to finely regulate the ratio between the fresh toner and the recovery toner to be replenished to the developing unit 14. Therefore, even when the image quality is deteriorated due to change of the environment of using toner or the like, it is possible to readily perform development with high image quality.

Further, on the basis of the counting result of the counting means 39, the operations of the conveying means 32 and the respective toner replenishing rollers 26 and 27 are controlled, with the result that it is possible to change the amount of the toner to be replenished from each of the toner replenishing rollers 26 and 27 to the developing unit 14 and the ratio between the fresh toner and the recovery toner in the toner. In addition to this, the amount of the recovery toner supplied to the recovery toner container 25 is regulated, whereby it is possible to change the amount of the recovery toner supplied to the recovery toner replenishing roller 27 and change the ratio of the recovery toner in the toner to be replenished to the developing unit 14. As a result, even when the quality of the recovery toner is deteriorated by repeatedly using the recovery toner in development of an electrostatic latent image, it is possible to increase the ratio of the fresh toner, thereby preventing the density of an image from degrading and the image quality from deteriorating.

Furthermore, when toner is replenished based on the output of the T sensor 21, the operations of the conveying means 32 and the respective toner replenishing rollers 26 and 27 are controlled so that the amount of the toner to be replenished from each of the toner replenishing rollers 26 and 27 to the developing unit 14 is relatively increased as compared with the amount of the toner supplied from the conveying means 32 to the recovery toner replenishing roller 27 in accordance with the counting result of the counting means 39. Therefore, it is possible to control the replenishing amount of the fresh toner and the recovery toner as well as control the ratio of the fresh toner in the toner to be replenished, and even when the quality of the recovery toner is deteriorated by repeatedly using the recovery toner in development of an electrostatic latent image and the image quality is deteriorated due to decrease of the concentration of toner, it is possible to increase the concentration of the toner and the ratio of the fresh toner, thereby avoiding a decrease of the density of an image and deterioration of the image quality.

The toner hopper 22 has the fresh toner container 24 and the recovery toner container 25, which are divided by the partition wall 23, so that it is not necessary to separately dispose a hopper for containing the fresh toner and a hopper for containing the recovery toner, and hence it is possible to implement a hopper for containing the fresh toner and the recovery toner at low cost.

Figure 2:
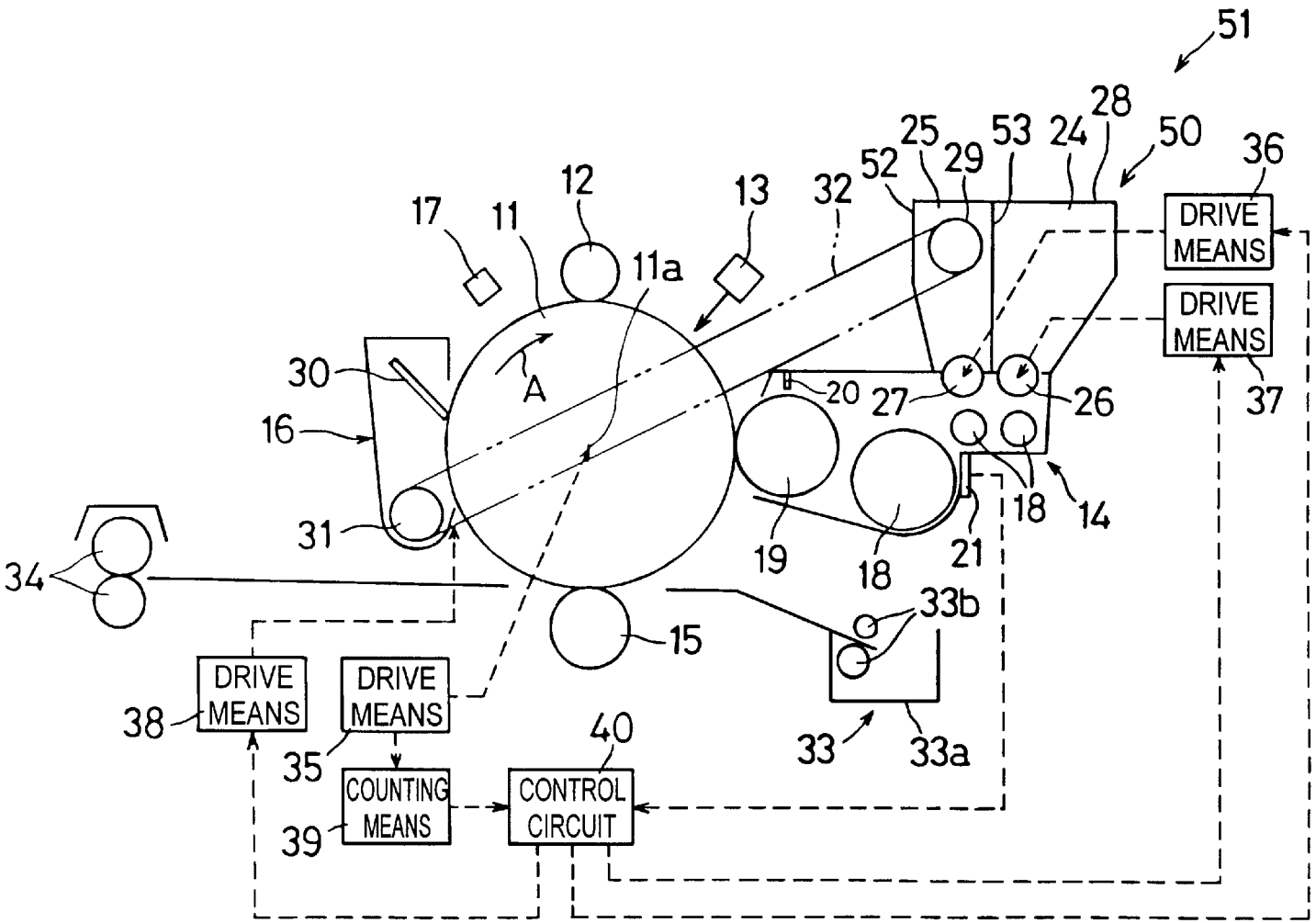
FIG. 2 is a sectional view showing a simplified configuration of an image forming apparatus equipped with a toner replenishing apparatus of another embodiment of the invention.
Figure 3:
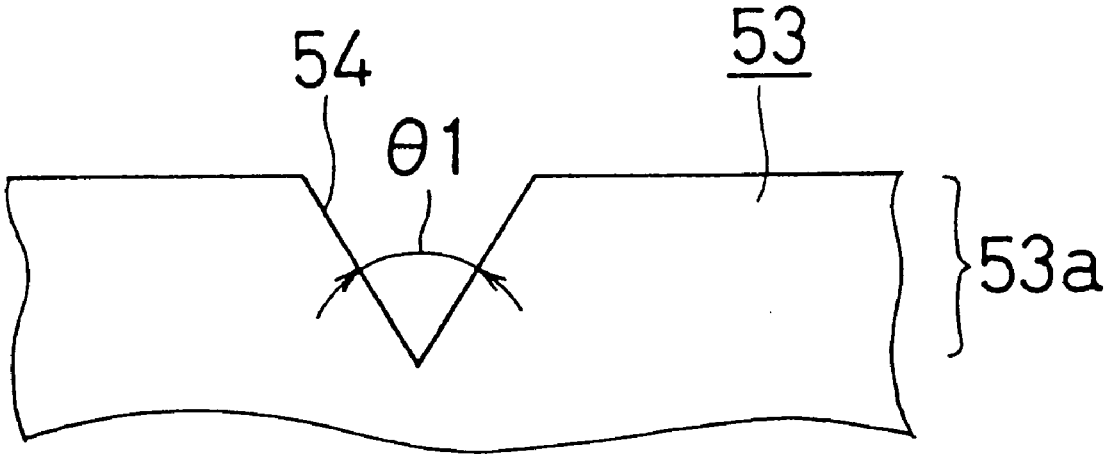
FIG. 3 is a front view showing an enlarged part of an upper edge of a partition wall disposed in a toner hopper.

FIG. 2 is a sectional view showing a simplified configuration of an image forming apparatus 51 equipped with a toner replenishing apparatus 50 of another embodiment of the invention, and FIG. 3 is a front view showing a enlarged part of an upper edge 53*a* of a partition wall 53 disposed to a toner hopper 52. In this embodiment of the invention, portions corresponding to those in the configuration of the above embodiment will be provided with the same reference numerals, and an illustration thereof will be omitted. The toner hopper 52 disposed to the toner replenishing apparatus 50 of the invention is similar in configuration to the toner hopper 22 as shown in FIG. 1. It is worthy of remark that in a case where the amount of the recovery toner contained in the recovery toner container 25 exceeds the predetermined capacity of the recovery toner container 25, the exceeding recovery toner flows into the fresh toner container 24 via a plurality of delta dams 54 which are disposed to the upper edge 53*a* of the partition wall 53.

The partition wall 53 is formed to extend from the bottom of the toner hopper 52 to the top plate 28 for closing the upper end of the toner hopper 52. To the upper edge 53*a* of the partition wall 53, the plurality of (two in the embodiment of the invention) delta dams 54 cut off into the shape of a V are disposed so as to be mutually spaced in the middle between both edges in the longitudinal direction which are perpendicular to the surface of the sheet of FIG. 2. Therefore, the fresh toner container 24 and the recovery toner container 25 lead to each other via the respective delta dams 54. It is desirable that the vertex θ1 of the respective delta dams 54 is set to be equal to or less than 90°, preferably equal to or less than 60°. As a result, fluidity of the recovery toner is ensured and the recovery toner is capable of smoothly flowing into the fresh toner container 24. In this configuration, it is possible to expect the same effect as in the embodiment of the invention as shown in FIG. 1.

Figure 4:
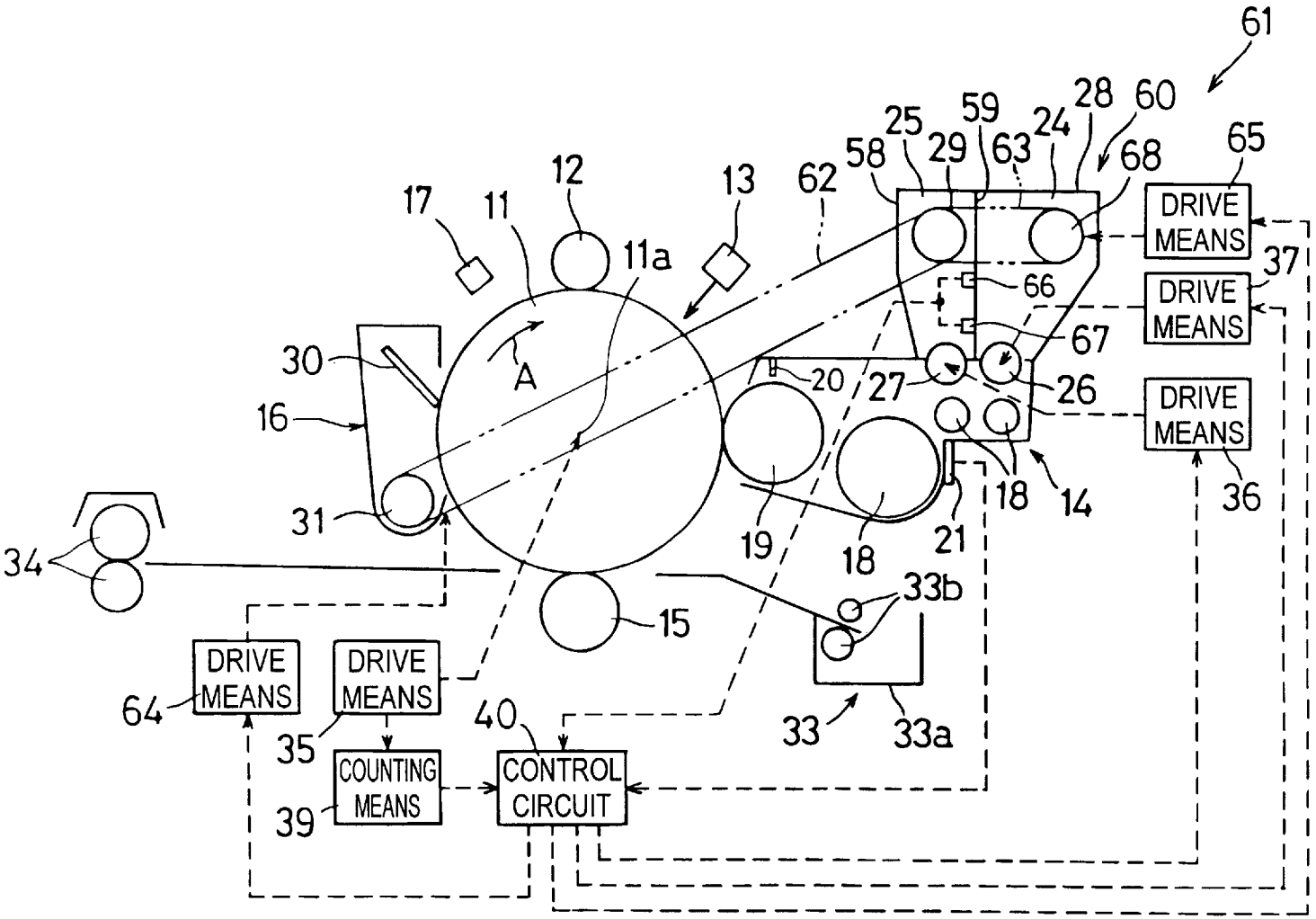
FIG. 4 is a sectional view showing a simplified configuration of an image forming apparatus equipped with a toner replenishing apparatus of still another embodiment of the invention.

FIG. 4 is a sectional view showing a simplified configuration of an image forming apparatus 61 equipped with a toner replenishing apparatus 60 of still another embodiment of the invention. In this embodiment of the invention, portions corresponding to those in the configuration of the above-described embodiments will be provided with the same reference numerals, and an illustration thereof will be omitted. The toner replenishing apparatus 60 of the invention is similar in configuration to the toner replenishing apparatuss 1 and 50 as shown in FIGS. 1 and 2. It is worthy of remark that in a case where the amount of the recovery toner contained in the recovery toner container 25 exceeds the predetermined capacity of the recovery toner container 25, the recovery toner conveyed by first conveying means 62 extending between the cleaning unit 16 and the recovery toner container 25 is conveyed to the fresh toner container 24 via second conveying means 63 extending between the recovery toner container 25 and the fresh toner container 24.

A toner hopper 58 is divided by a partition wall 59 extending between the bottom and the top plate 28 of the toner hopper, whereby the fresh toner container 24 and the recovery toner container 25 are formed. The first conveying means 62 and the second conveying means 63 are identical in configuration to the conveying means 32 as shown in FIGS. 1 and 2, and implemented by a screw conveyor or the like. The respective screws of the first conveying means 62 and the second conveying means 63 are rotatably driven, respectively, by first screw drive means 64 and second screw drive means 65 which comprise an electric motor or the like. The partition wall 59 facing the side of the recovery toner container 25 is provided with a fullness detecting sensor 66 serving as capacity excess detecting means for detecting that the amount of the recovery toner which is contained exceeds the predetermined capacity, and a recovery toner amount detecting sensor 67 for detecting that the amount of the recovery toner which is contained becomes less than the predetermined capacity. The control circuit 40 controls the first screw drive means 64 in the same manner as 17 controls the screw drive means 38 as shown in FIGS. 1 and 2. The control circuit 40 controls the operation of the second screw drive means 65 in accordance with the outputs of the fullness detecting sensor 66 and the recovery toner amount detecting sensor 67.

When the fullness detecting sensor 66 detects that the amount of the recovery toner exceeds the predetermined capacity of the recovery toner container 25, the control circuit 40 closes the recovery toner bringing path 29 of the first conveying means 62, opens the recovery toner bringing path 68 of the second conveying means 63 and drives the second screw drive means 65. As a result, the recovery toner conveyed by the first conveying means 62 is conveyed to the fresh toner container 24 via the second conveying means 63, to be contained therein. When the recovery toner amount detecting sensor 67 detects that the amount of the recovery toner contained in the recovery toner container 25 becomes less than the predetermined capacity, the control circuit 40 stops drive the second screw driving means 65, closes the recovery toner bringing path 68 of the second conveying means 63 and opens the recovery toner bringing path 29 of the first conveying means 62. As a result, the recovery toner conveyed by the first conveying means 62 is conveyed to the recovery toner container 25, to be contained therein.

In this configuration, it is not required that the user executes confirmation of the condition of the recovery toner container 25 and the like, and the overflow of the recovery toner is not caused by carelessness of the user, with the result that it is possible to implement the toner replenishing apparatus 60 with operability. Toner is replenished also in the same manner as in the embodiments of the invention as shown in FIGS. 1 to 3.

Figure 5:
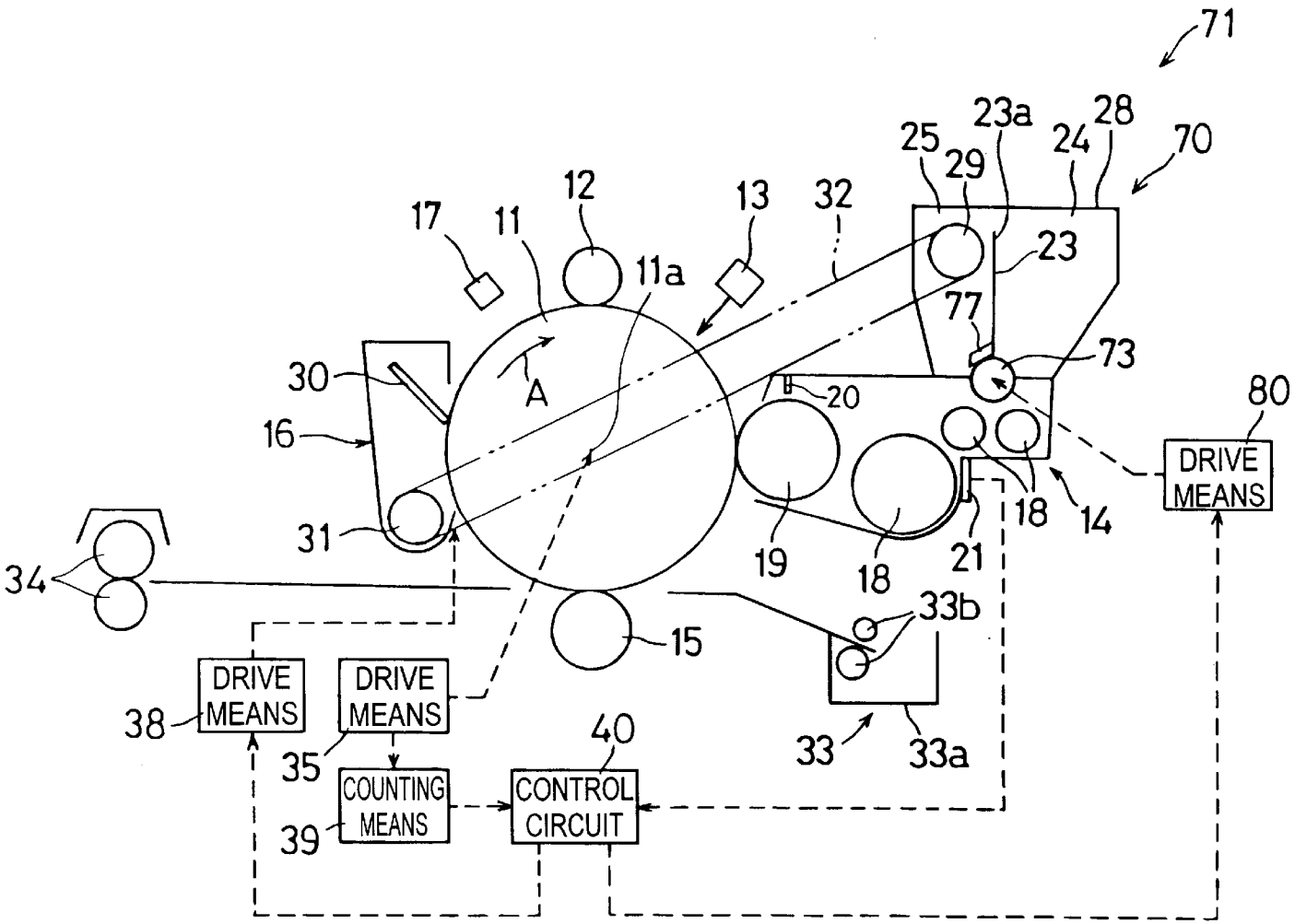
FIG. 5 is a sectional view showing a simplified configuration of an image forming apparatus equipped with a toner replenishing apparatus of yet still another embodiment of the invention.
Figure 6:
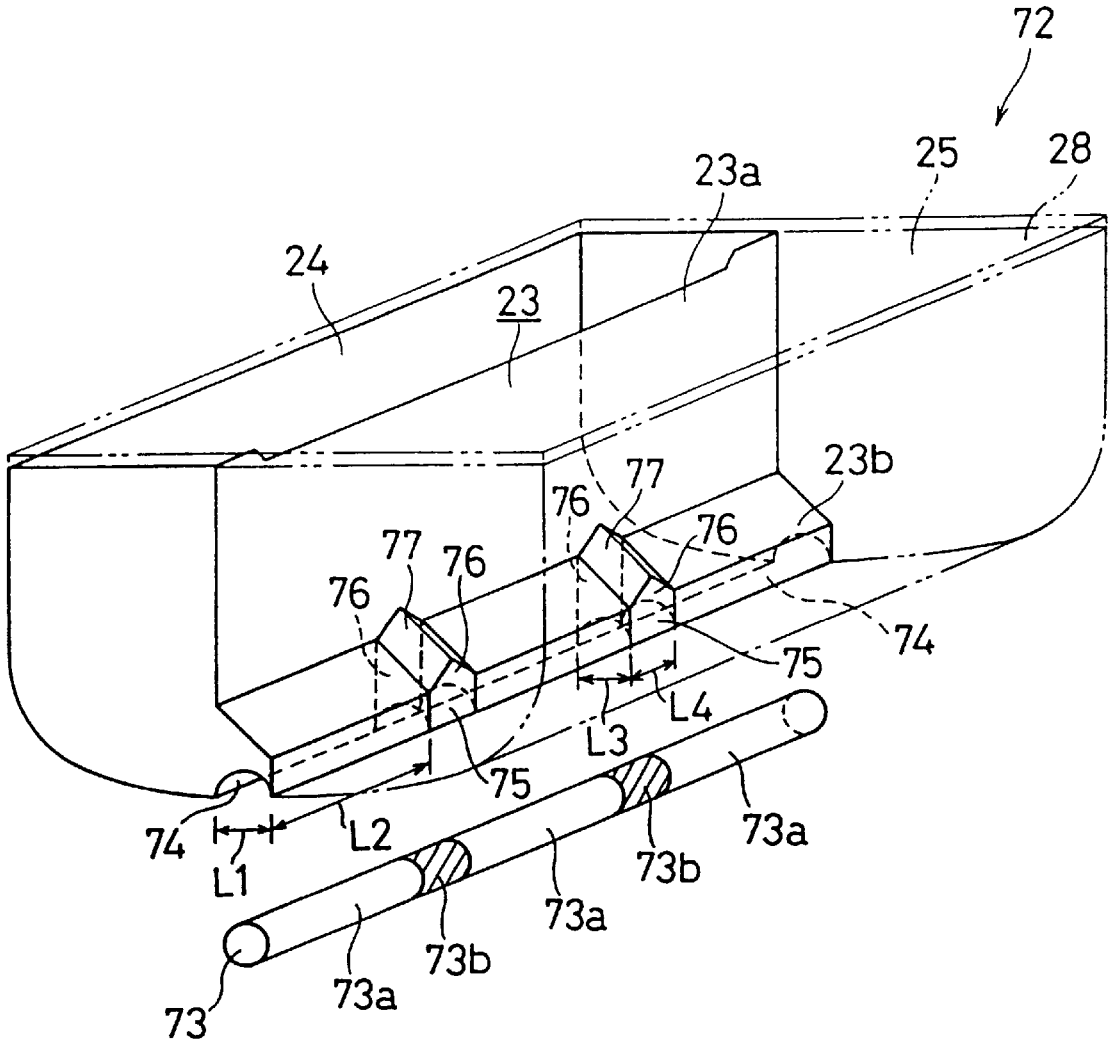
FIG. 6 is a perspective view showing a simplified configuration of a toner hopper and a toner replenishing roller.

FIG. 5 is a sectional view showing a simplified configuration of an image forming apparatus 71 equipped with a toner replenishing apparatus 70 of yet still another embodiment of the invention, and FIG. 6 is a perspective view showing a simplified configuration of a toner hopper 72 and a toner replenishing roller 73. In this embodiment of the invention, portions corresponding to those in the configuration of the above-described embodiments will be provided with the same reference numerals, and an illustration thereof will be omitted. The toner replenishing apparatus 70 of the invention is similar in configuration to the toner replenishing apparatus 1 as shown in FIG. 1. It is worthy of remark that the fresh toner and the recovery toner are replenished to the developing unit 14 by a single toner replenishing roller 73.

At the bottom of the toner hopper 72, the toner replenishing roller 73 for replenishing the fresh toner and the recovery toner to the developing unit 14 is placed in nearly the center in the direction of the width perpendicular to the longitudinal direction, along the longitudinal direction. Further, at the bottom of the toner hopper 72, a plurality of (three in the embodiment of the invention) first toner supply orifices 74 which opens so as to face the toner replenishing roller 73 and supplies the fresh toner to the toner replenishing roller 73, and a plurality of (two in the embodiment of the invention) second toner supply orifices 75 which opens so as to face the toner replenishing roller 73 and supplies the recovery toner to the toner replenishing roller 73, are alternately arranged. As for the lower edge 23*b* of the partition wall 23, parts facing the respective first toner supply orifices 74 are bent and projected to the side of the recovery toner container 25 and connected to the bottom on the side of the recovery toner container 25, and parts facing the respective second toner supply orifices 75 are connected to the bottom on the side of the fresh toner container 24. Between the respective first toner supply orifices 74 and the respective second toner supply orifices 75, dividing boards 76 for dividing the respective first toner supply orifices 74 and the respective second toner supply orifices 75 are disposed, respectively. The upper ends of the respective dividing boards 76 are connected to the lower end of the partition wall 23 facing the respective first toner supply orifices 74.

The opening area of the respective first toner supply orifices 74 is larger than the opening area of the respective second toner supply orifices 75. An example of the dimension of the respective first toner supply orifices 74 and the dimension of the respective second toner supply orifices 75, is as follows. For example, the length L1 of the first toner supply orifice 74 in the width direction is 16 mm and the length L2 thereof in the longitudinal direction is 65.3 mm. For example, the length L3 of the second toner supply orifice 75 in the width direction is 16 mm and the length L4 thereof in the longitudinal direction is 42 mm. That is to say, the sum of the opening areas of the first toner supply orifices 74 is designed to be larger than the sum of the opening areas of the second toner supply orifices 75. In this embodiment of the invention, in the case of comparing the sums of projected areas on the toner replenishing roller 73, the sum of the projected areas of the second toner supply orifices 75 is 1344 $mm^2$ and the sum of the projected areas of the first toner supply orifices 74 is 3134.4 $mm^2$. In other words, the ratio between the opening areas of the first toner supply orifices 74 and the opening areas of the second toner supply orifices 75 is designed to be nearly 7:3. As a result, the amount of the fresh toner supplied from the respective first toner supply orifices 74 to the toner replenishing roller 73 is designed to be more than the amount of the recovery toner supplied from the respective second toner supply orifices 75 to the toner replenishing roller 73. In this embodiment of the invention, the ratio between the fresh toner and the recovery toner supplied to the toner replenishing roller 73 is selected to be nearly 7:3.

Figure 7:
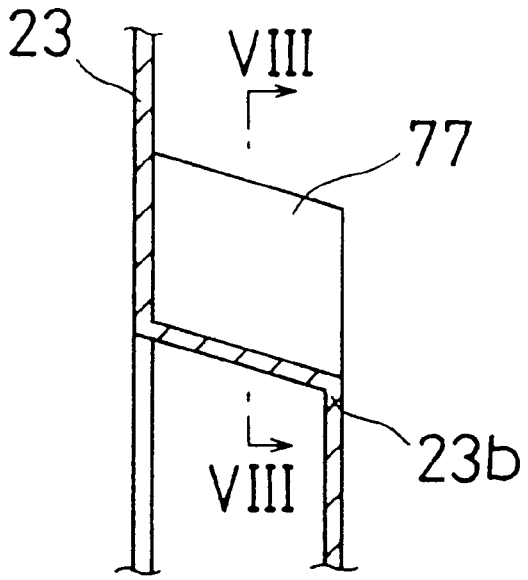
FIG. 7 is a side view showing a simplified configuration of a covering member.
Figure 8:
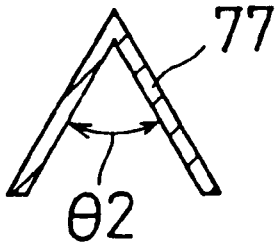
FIG. 8 is a sectional view taken on line VIII—VIII of FIG. 7.

FIG. 7 is a simplified side view showing a covering member 77, and FIG. 8 is a sectional view taken on line VIII—VIII of FIG. 7. Also with reference to FIG. 6, to the lower part of the partition wall 23, the covering members 77 for covering the respective second toner supply orifices 75, the covering members having a sectional shape of an inverted V, are disposed at positions facing the respective second toner supply orifices 75 from above, respectively. It is desirable that the vertex θ2 of the respective covering members 77 is set to be, for example, equal to or less than 90°, preferably equal to or less than 60°.

As a result of disposing the covering members 77, the recovery toner with less fluidity than the fresh toner is no more supplied concentratedly onto the respective second toner supply orifices 75, and a problem is thereby avoided such that the respective second toner supply orifices 75 having a smaller opening area than the respective first toner supply orifices 74 are closed by the recovery toner.

In this configuration, it is possible to supply only the fresh toner to the respective first toner supply orifices 74 and supply only the recovery toner to the respective second toner supply orifices 75.

Figure 9:
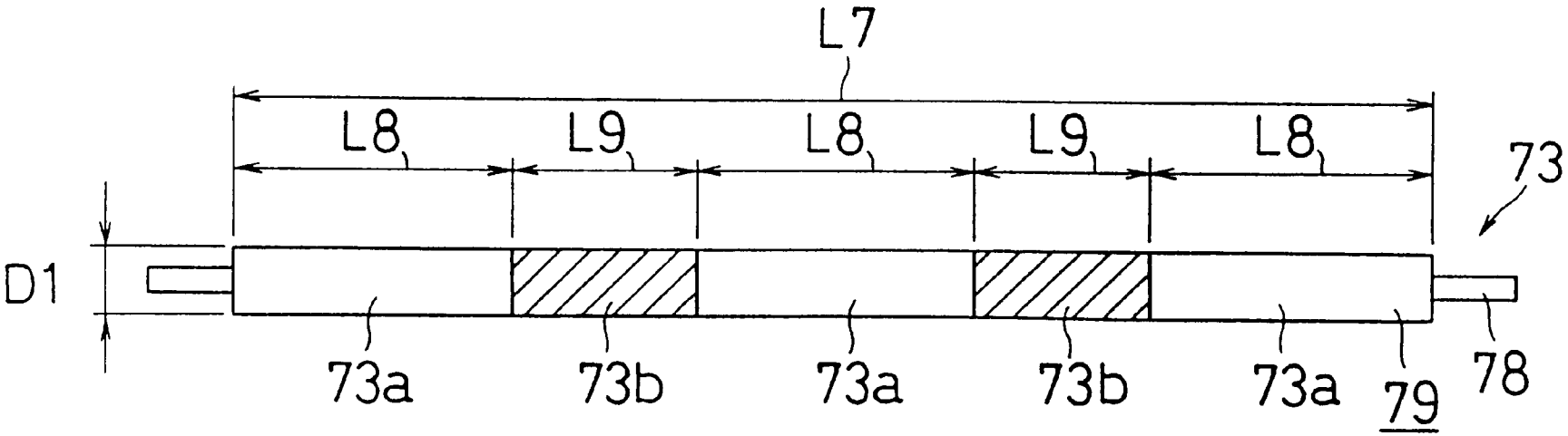
FIG. 9 is a front view showing a simplified configuration of the toner replenishing roller.

FIG. 9 is a front view showing a simplified configuration of the toner replenishing roller 73. Also with reference to FIGS. 5 and 6, the toner replenishing roller 73 includes an axis portion 78 made of metal, and a replenishing portion 79 which is fitted to the axis portion 78, made of a porous elastic material such as sponge and formed into a shape of a right circular cylinder. As for the amount of the toner to be replenished to the developing unit 14 by the toner replenishing roller 73, the number of cells contained in the replenishing portion 79 is selected so that the amount of the toner replenished by the toner replenishing roller 73 in a region 73*a* corresponding to each of the first toner supply orifices 74 is more than the amount of the toner replenished by the toner replenishing roller 73 in a region 73*b* (diagonally shaded parts in FIGS. 6 and 9) corresponding to each of the second toner supply orifices 75.

Figure 10:
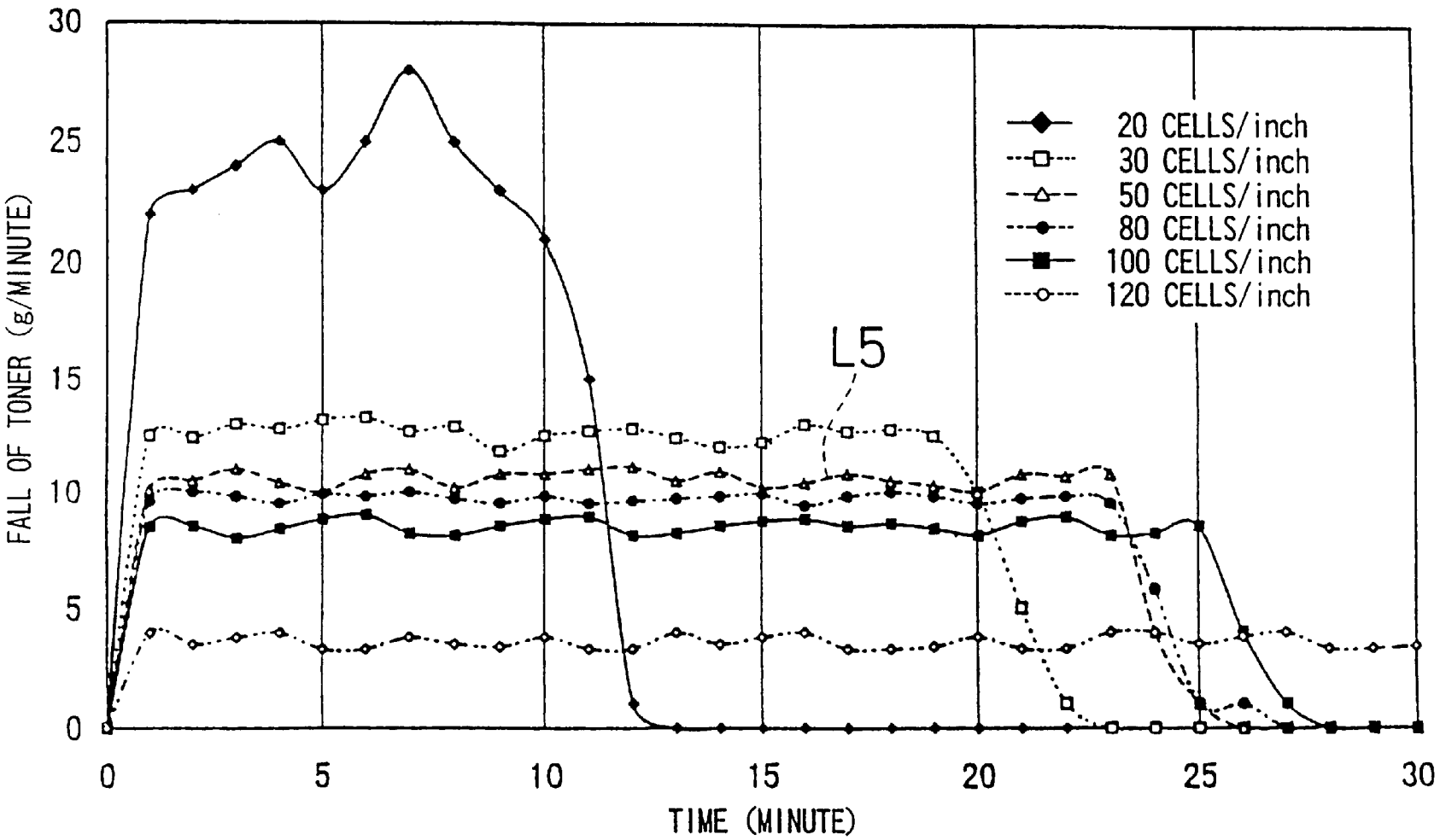
FIG. 10 is a graph showing the relation between the number of cells per unit length contained in a replenishing section and the amount of fall of fresh toner.
Figure 11:
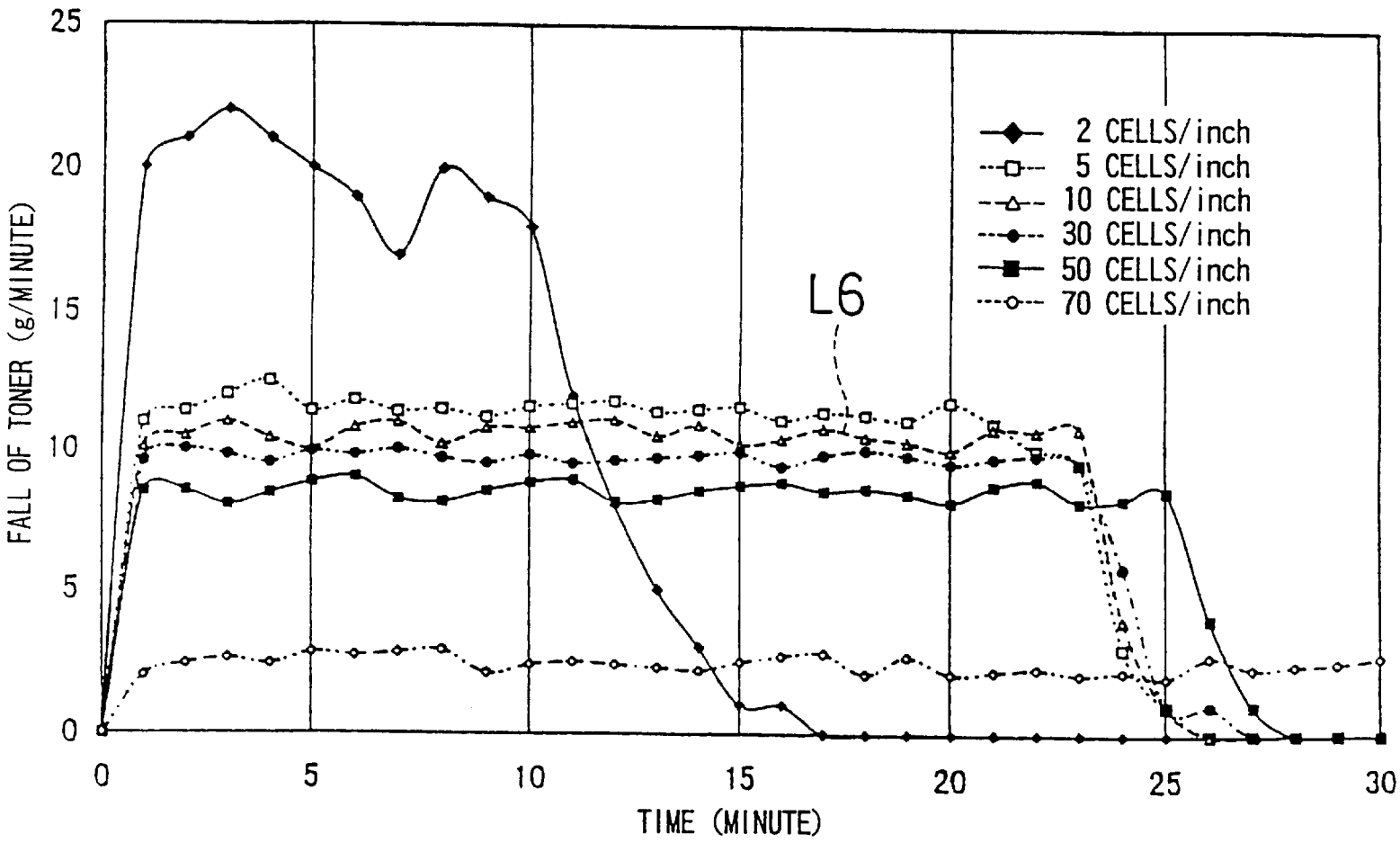
FIG. 11 is a graph showing the relation between the number of cells per unit length contained in the replenishing section and the amount of fall of recovery toner.

FIG. 10 is a graph showing the relation between the number of cells per unit length contained in the replenishing portion 79 and the amount of fall of the fresh toner, and FIG. 11 is a graph showing the relation between the number of cells per unit length contained in the replenishing portion 79 and the amount of fall of the recovery toner. In FIGS. 10 and 11, the horizontal axis indicates rotation time of the toner replenishing roller 73, and the vertical axis indicates the amount of fall of the toner. In FIGS. 10 and 11, it is worthy of remark that the amount of fall from the replenishing portion 79 made of a material containing 50 cells per inch as shown by a line L5 of FIG. 10 is almost equal to the amount of fall from the replenishing portion 79 containing 10 cells per inch as shown by a line L6 of FIG. 11. In other words, the material of the regions 73*a* corresponding to the respective first toner supply orifices 74 in the replenishing portion 79 is selected to be a material containing 50 cells per inch, and the material of the regions 73*b* corresponding to the respective second toner supply orifices 75 in the replenishing portion 79 is selected to be a material containing 10 cells per inch, whereby the amounts of fall per unit area of the fresh toner and the recovery toner become equal to each other. As a result, by changing the areas of the respective regions 73*a* and 73*b* corresponding to the respective first and second toner supply orifices 74 and 75, it is possible to make the amount of the fresh toner more than the amount of the recovery toner in the toner to be replenished to the developing unit 14.

Here, one example of the dimension of the toner replenishing roller 73 is as follows. The length L7 of the replenishing portion 79 in the longitudinal direction is, e.g., 280 mm, and the outer diameter D1 of the replenishing portion 79 is, e.g., about 16 mm. In the replenishing portion 79, the length L8 of the region corresponding to each first toner supply orifice 74 in the longitudinal direction is, e.g., 65.3 mm, while the length L9 of the region corresponding to each second toner supply orifice 75 in the longitudinal direction is, e.g., 42 mm.

In this way, since the pluralities of first and second toner supply orifices 74, 75 are alternatively arranged, and each of the first and second toner supply orifices 74, 75 is opened so as to face the same toner replenishing roller 73, it is possible to supply the fresh toner and recovery toner to the same toner replenishing roller 73. As a result, it is not necessary to dispose means for replenishing fresh toner to the developing unit 14 and means for replenishing recovery toner to the developing unit 14 individually, so that it is possible to simplify the configuration and reduce the production cost.

Further, the opening area of each first toner supply orifice 74 is larger than the opening area of each second toner supply orifice 75, so that it is possible to set the ratio of the fresh toner in the toner supplied to the toner replenishing roller 73 higher than that of the recovery toner in the same, and hence it is possible to readily raise the ratio of the fresh toner in the toner to be replenished to the developing unit 14 from the toner replenishing roller 73. Furthermore, by setting the sum of the opening areas of the first toner supply orifices 74 larger than the sum of the opening areas of the second toner supply orifices 75, it is possible to make the ratio of the fresh toner in the toner supplied to the toner replenishing roller 73 higher than the ratio of recovery toner regardless of the respective opening areas of the first and second toner supply orifices 74, 75.

Further, as for the toner replenishing amount by the toner replenishing roller 73 to the developing unit 14, the toner replenishing amount of the toner replenishing roller 73 in the region 73*a* corresponding to each first toner supply orifice 74 is larger than that in the region 73*b* corresponding to each second toner supply orifice 75, so that it is possible to make the ratio of the fresh toner in the toner within the developing unit 14 higher than the ratio of the recovery toner, and hence it is possible to prevent the image density from being decreased and the image quality from being deteriorated.

With reference to FIG. 5, the control circuit 40 controls revolutions or rotation time of the toner replenishing roller drive means 80 which comprises an electric motor or the like, thereby controlling the operation of the toner replenishing roller 73. Usually, the ratio between the fresh toner and the recovery toner in the toner to be replenished to the developing unit 14 is about 7:3, however, the ratio between the fresh toner and the recovery toner may be finely adjusted by varying the revolutions of the toner replenishing roller 73.

Figure 12:
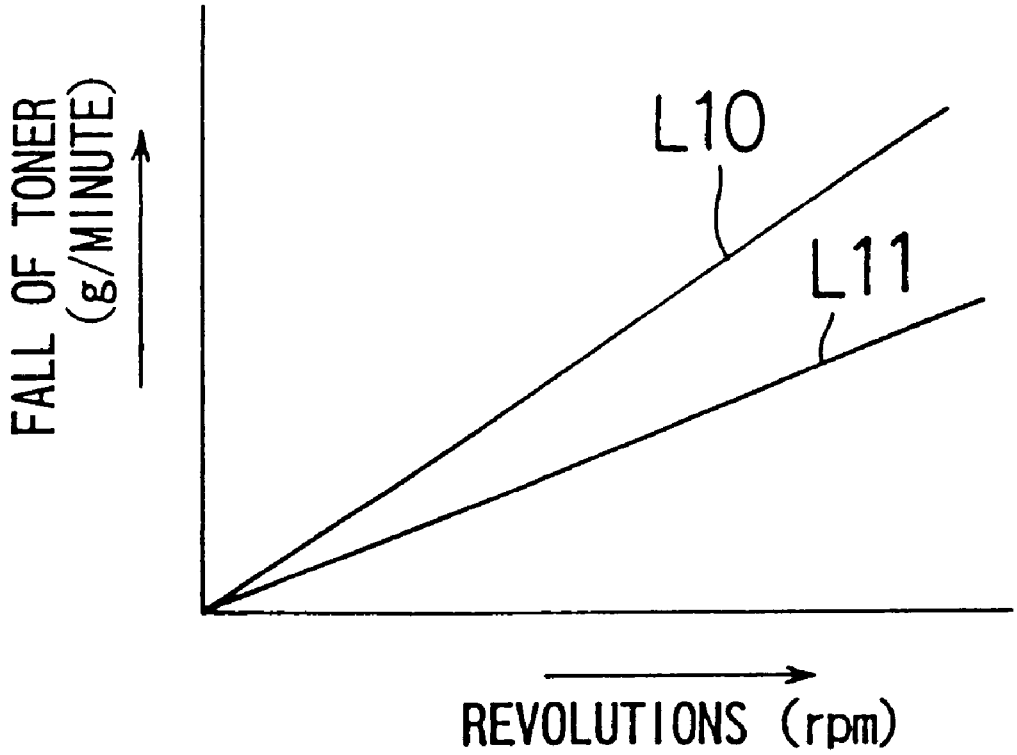
FIG. 12 is a graph showing the relation between the number of rotations of the toner replenishing roller and the amounts of fall of the fresh toner and the recovery toner.

FIG. 12 is a graph showing relations between revolutions of the toner replenishing roller 73 and amounts of fall of the fresh toner and the recovery toner. In FIG. 12, the horizontal axis indicates revolutions of the toner replenishing roller 73, and the vertical axis indicates amount of fall of toner. The line L10 in the graph represents amounts of fall of fresh toner, and the line L11 amounts of fall of recovery toner. It can be seen from FIG. 12 that the amounts of fall of the fresh toner and recovery toner increase straight with the increase of the revolutions of the toner replenishing roller 73, while the inclination of the amount of fall of the fresh toner is larger than that of the recovery toner. In other words, it can be seen that the fresh toner and the recovery toner are different from each other in adhesive characteristics to the toner replenishing roller 73. Therefore, by setting the revolutions of the toner replenishing roller 73 to be larger than that in the case of supplying toner to the developing unit 14 at the ratio between the fresh toner and the recovery toner of 7:3, it is possible to increase the amount of the toner supplied to the developing unit 14 as well as to increase the amount of the fresh toner much more than the recovery toner, thereby raising the ratio of the fresh toner in the toner much more than the recovery toner. In this way, by finely adjusting the ratio between the fresh toner and the recovery toner, it is possible to readily perform development with high image quality even when the image quality is deteriorated due to changes in use environment of the toner.

Further, to conduct the fine adjustment of the ratio between fresh toner and recovery toner, it is also possible to control the operations of the conveying means 32 and the toner replenishing roller 73 on the basis of the counting result of the counting means 32 and the output of the T sensor 21. With such a configuration, owing to the difference between the fresh toner and the recovery toner in adhesive characteristics to the toner replenishing roller 73, it is possible to change the amount of the toner to be replenished to the developing unit 14 by the toner replenishing roller 73 and the ratio between the fresh toner and the recovery toner in the toner, as well as to change the amount of the recovery toner supplied to the toner replenishing roller 73 by adjusting the amount of the recovery toner supplied to the recovery toner container, thereby changing the ratio of the recovery toner in the toner to be replenished to the developing unit 14. Therefore, even when the quality of the recovery toner is deteriorated due to repeated uses for development of an electrostatic latent image, by increasing the ratio of the fresh toner, it is possible to prevent the image density from being reduced and the image quality from being deteriorated. Furthermore, also in the case of replenishing the toner on the basis of the output of the T sensor 21, by controlling the revolutions of the toner replenishing roller 73 and the revolutions or rotation time of the screw of the conveying means 32, it is possible to control the amounts of the fresh toner and the recovery toner to be replenished as well as to control the ratio of the fresh toner in the toner to be replenished, the same as the embodiment of the invention shown in FIG. 1. Also, changeover of the route of recovery toner is carried out in the same manner as the embodiment of the invention shown in FIG. 1.

Figure 13:
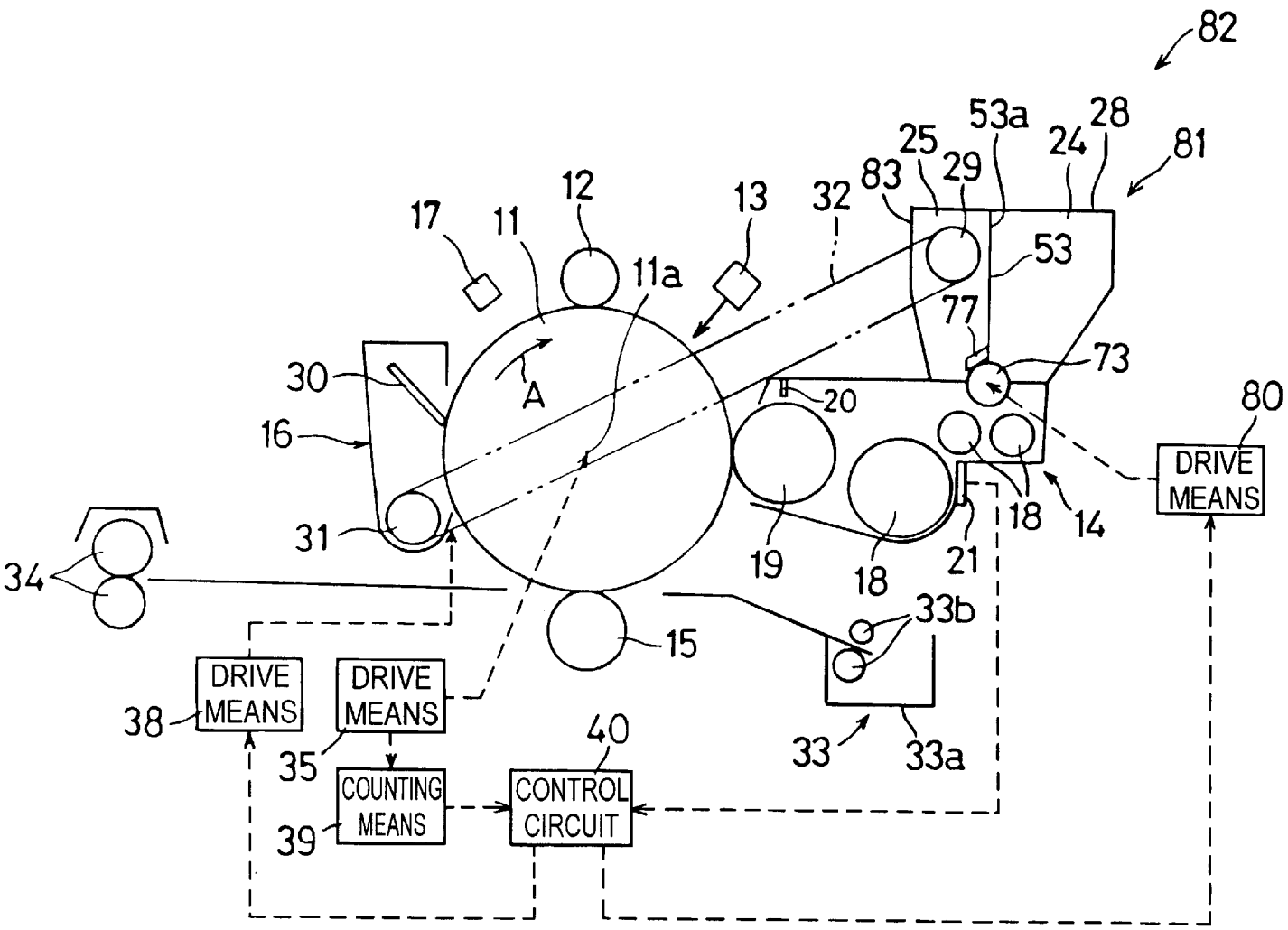
FIG. 13 is a sectional view showing a simplified configuration of an image forming apparatus equipped with a toner replenishing apparatus of a further embodiment of the invention.
Figure 14:
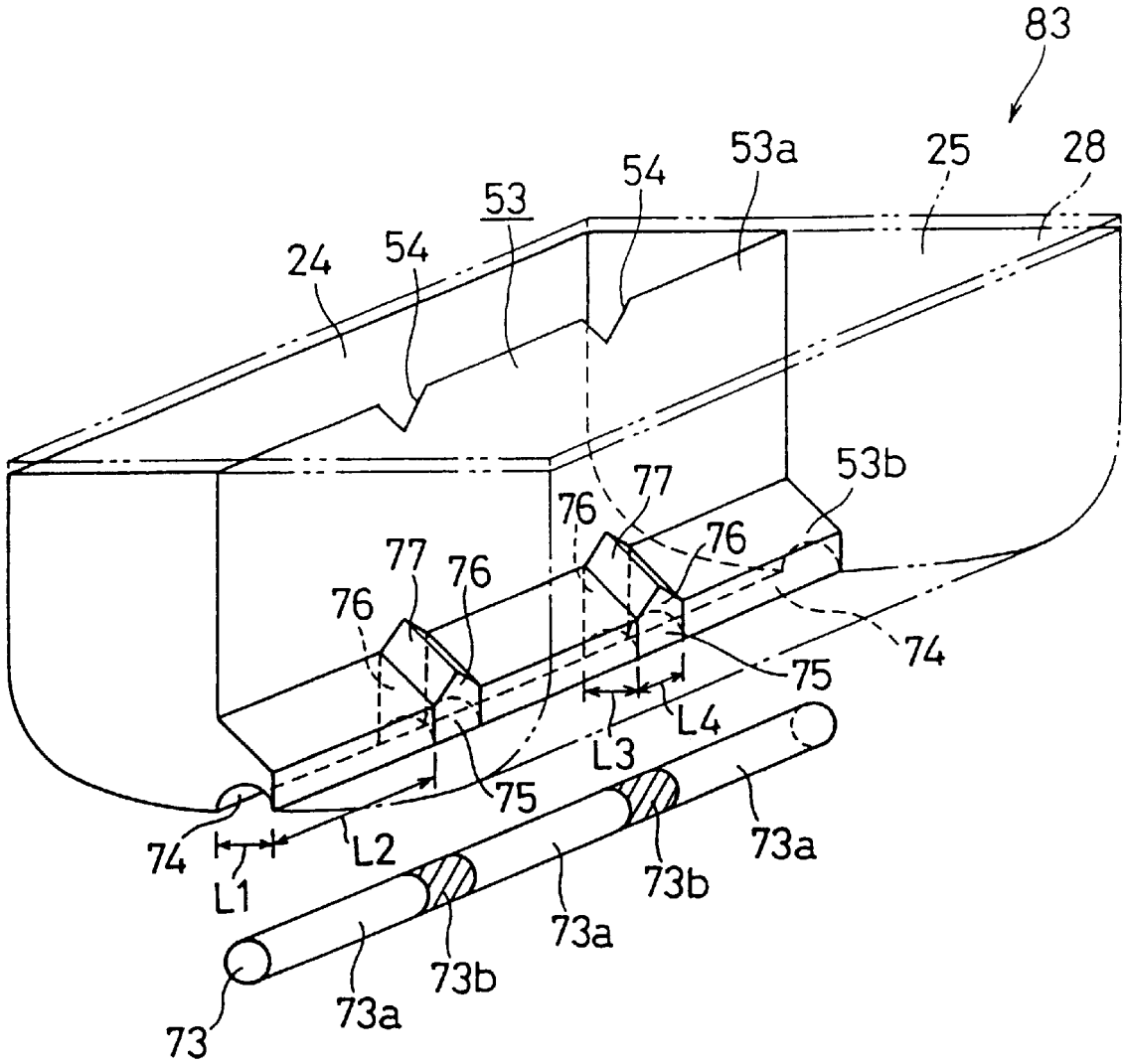
FIG. 14 is a perspective view showing a simplified configuration of a toner hopper and the toner replenishing roller.

FIG. 13 is a sectional view showing a simplified configuration of an image forming apparatus 82 equipped with a toner replenishing apparatus 80 of a further embodiment of the invention, and FIG. 14 is a perspective view showing a simplified configuration of a toner hopper 83 and the toner replenishing roller 73. In this embodiment of the invention, portions corresponding to those in the configuration of the above-described embodiments will be provided with the same reference numerals, and illustration thereof will be omitted. The toner replenishing apparatus 81 of the invention is similar in configuration to the toner replenishing apparatus 50 as shown in FIG. 2. It is worthy of remark that the fresh toner and the recovery toner are replenished to the developing unit 14 by the single replenishing roller 73. The bottom of the toner hopper 83 has a similar configuration to the bottom of the toner hopper 72 as shown in FIG. 5, and at a lower edge 53*b* of the partition wall 53, the covering members 77 are disposed at positions facing the respective second toner supply orifices 75 from above. At the upper edge 53*a* of the partition wall 53, the delta dams 54 are formed right above the respective covering members 77. Since the delta dams 54 are formed right above the respective covering members 77, when the recovery toner contained in the recovery toner container 25 exceeds the predetermined capacity of the recovery toner container 25, the recovery toner existing right above each second toner supply orifice 75 dominantly flows into the fresh toner container 24, so that it is possible to prevent the load from concentrating on the recovery toner in the vicinity of each of the second toner supply orifices 75.

Control of each drive means 38, 80 by the control circuit 40 is executed in the same manner as mentioned in the operation of the toner replenishing apparatus 70 of FIGS. 5 to 12. Therefore, by controlling each drive means 38, 80 by the control circuit 40, it is possible to finely adjust the ratio between the fresh toner and the recovery toner, and thus it is possible to obtain the effects the same as the toner replenishing apparatus 70 shown in FIGS. 5 to 12.

Figure 15:
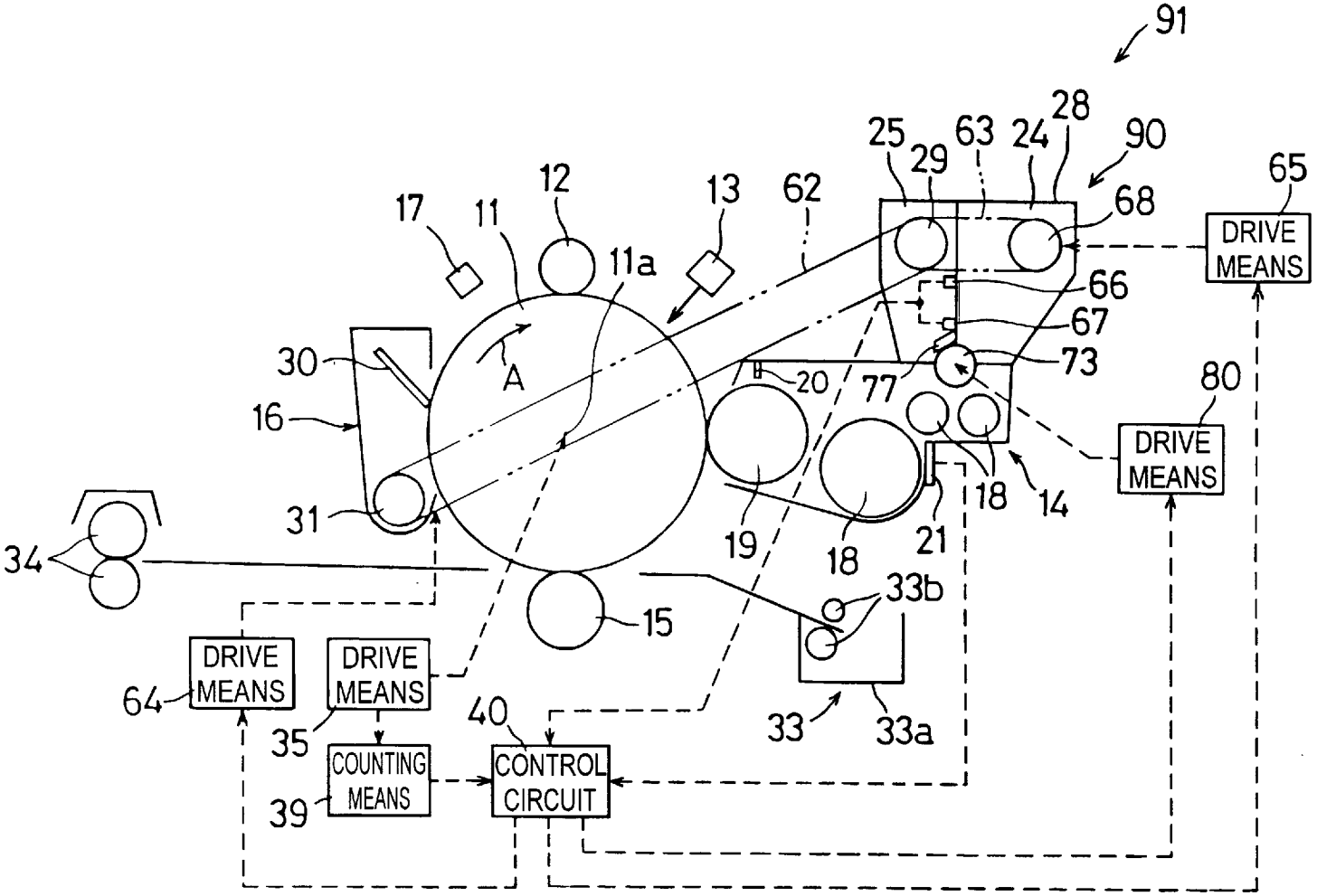
FIG. 15 is a sectional view showing a simplified configuration of an image forming apparatus equipped with a toner replenishing apparatus of a still further embodiment of the invention.

FIG. 15 is a sectional view showing a simplified configuration of an image forming apparatus 91 equipped with a toner replenishing apparatus 90 of a still further embodiment of the invention. In this embodiment of the invention, portions corresponding to those in the configuration of the above-described embodiments will be provided with the same reference numerals, and illustration thereof will be omitted. The toner replenishing apparatus 90 of the invention is similar in configuration to the toner replenishing apparatus 60 as shown in FIG. 4. It is worthy of remark that the fresh toner and the recovery toner are replenished to the developing unit 14 by the single replenishing roller 73.

A lower end 59*b* of a partition wall 59 and the bottom portion of a toner hopper 58 are connected in the same manner as the toner hoppers 72, 83 shown in FIGS. 5 to 14, and thus illustration thereof will be omitted. Also as for the first conveying means 62 and the second conveying means 63, they are located in the same manner as the toner replenishing apparatus 60 shown in FIG. 4, and thus illustration thereof will be omitted. Effect of the changeover of the route of recovery toner from the recovery toner container 25 to the fresh toner container 24 are the same as the effects obtained in the replenishing apparatus 50 shown in FIG. 4, and effects of controlling the operations of each drive means 38, 80 by the control circuit 40 are the same as the effects in the toner replenishing apparatuss 70, 81 shown in FIGS. 5 to 14.

In the embodiment of the invention as shown in FIGS. 5 to 12, two second toner supply orifices 75 are provided, however, three second toner supply orifices 75 may be provided alternatively. In that case, the length L2 of the first toner supply orifice 74 in the longitudinal direction is, e.g., 49 mm, while the length L4 of the second toner supply orifice 75 in the longitudinal direction is, e.g., 28 mm.

Furthermore, the sum of the projected areas of the first toner supply orifices 74 on the toner replenishing roller 73 is 3136 $mm^2$, and the sum of the projected areas of the second toner supply orifices 75 on the toner replenishing roller 73 is, e.g., 1344 $mm^2$. Accordingly, the ratio between the amount of the fresh toner supplied to the toner replenishing roller 73 from the first toner supply orifices 74 and the amount of the recovery toner supplied to the toner replenishing roller 73 from the second toner supply orifices 75 becomes 7:3. In association with this, the region 73*a* of the replenishing portion 79 of the toner replenishing roller 73 corresponding to the first toner supply orifice 74 has a length L8 of, e.g., 49 mm in the longitudinal direction, while the region 73*b* corresponding to the second toner supply orifice 75 has a length L9 of, e.g., 28 mm in the longitudinal direction. Also with such a configuration, the same effects as the toner replenishing apparatus 70 shown in FIGS. 5 to 12 can be obtained.

Figure 16:
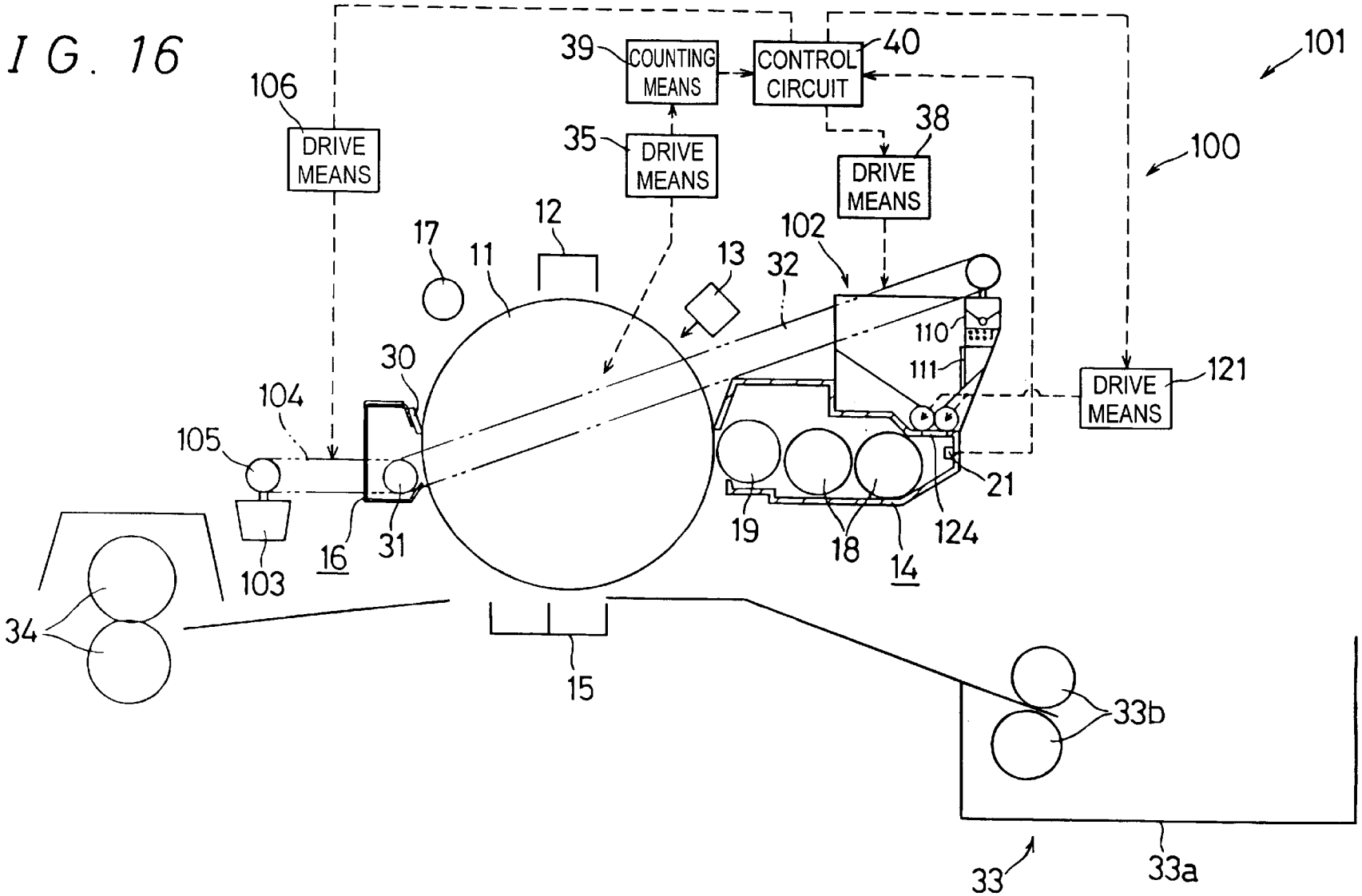
FIG. 16 is a sectional view showing a simplified configuration of an image forming apparatus equipped with a toner replenishing apparatus of a yet still further embodiment of the invention.
Figure 17:
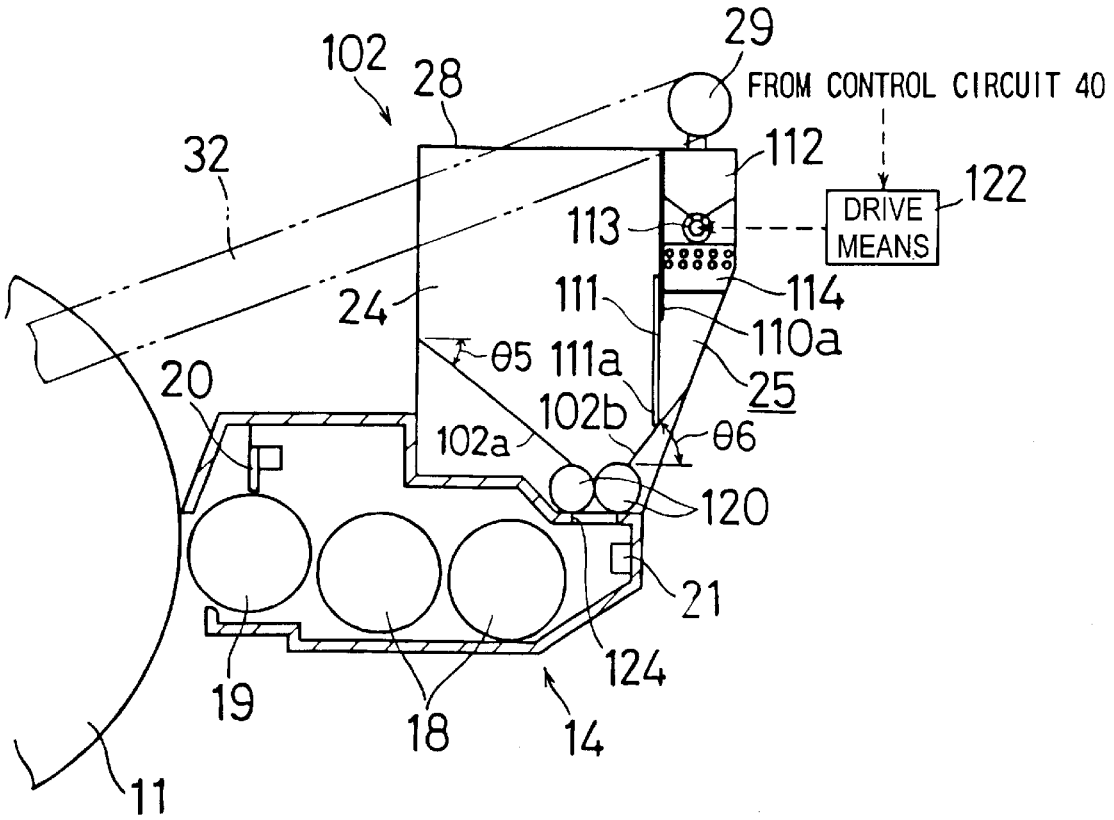
FIG. 17 is a sectional view showing the enlarged vicinity of the developing unit.
Figure 18:
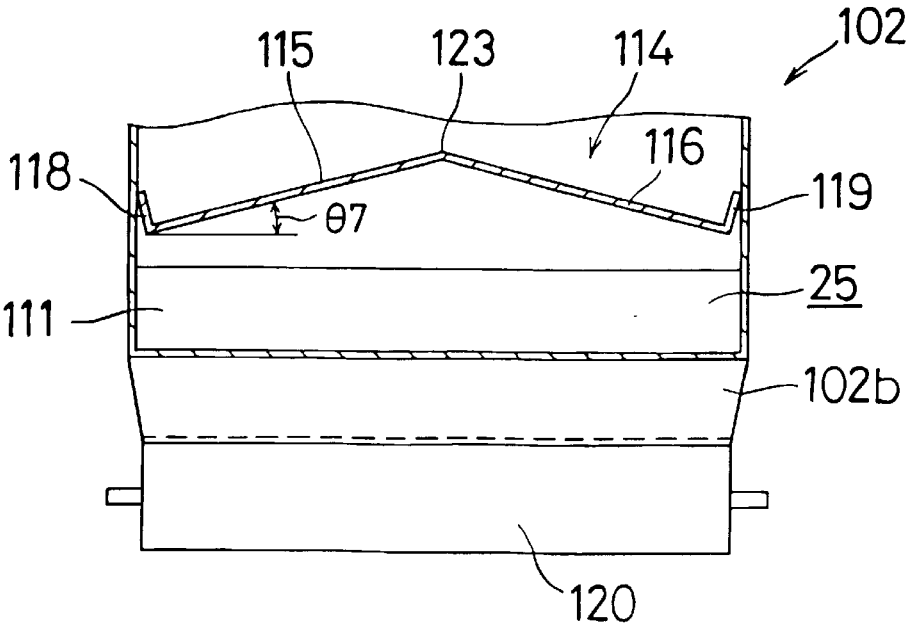
FIG. 18 is an enlarged side view showing cut part of a toner hopper.

FIG. 16 is a sectional view showing a simplified configuration of an image forming apparatus 101 equipped with a toner replenishing apparatus 100 of a yet still further embodiment of the invention, FIG. 17 is a sectional view showing in enlarged dimension the vicinity of the developing unit 14, and FIG. 18 is an enlarged side view of a toner hopper 102, partly broken away. In this embodiment of the invention, portions corresponding to those in the configuration of the above-described embodiments will be provided with the same reference numerals, and illustration thereof will be omitted. The toner replenishing apparatus 100 is similar in configuration to the toner replenishing apparatus 1, 50, 60, 70, 81, 90 as shown in FIGS. 1 to 15. It is worthy of remark that the toner replenishing apparatus 100 has a waste toner hopper 103 serving as a waste toner container into which part of the toner recovered by the cleaning unit 16 is discarded and contained, and that waste toner conveying means 104 for conveying the recovery toner to be discarded from the cleaning unit 16 to the waste toner hopper 103. The waste toner conveying means 104 is implemented by a screw conveyer or the like, and is formed to span the discharging path of the discharging means 31 of the cleaning unit 16 and the toner bringing path 105 of the waste toner hopper 103. The waste toner conveying means 104 is rotatably driven by means of screw drive means 106 whose screw comprises an electric motor or the like. The operation of the screw drive means 106 is controlled by means of the control circuit 40, whereby the rotation time or revolutions of the waste toner conveying means 104 is controlled.

The toner hopper 102 is divided into the fresh toner container 24 and the recovery toner container 25 by means of a partition wall 110 extending from the upper end toward the bottom of the toner hopper 102, the partition wall 110 extending between the upper end and a midpoint between the upper end and the bottom of the toner hopper 102. In that case, the capacity of the fresh toner container 24 is selected to be larger than that of the recovery toner container 25. The partition wall 110 is provided with a toner counterflow preventing member 111 which extends from a lower edge 110*a* thereof to the bottom of the toner hopper 102 and which is made of a flexible elastic material such as PET (polyethylene terephthalate) or the like. The thickness of the toner counterflow preventing member 111 is, e.g., 0.5 mm.

The recovery toner container 25 is provided with: a reservoir 112 for temporarily reserving the recovery toner which is conveyed by the conveying means 32 serving as recovery toner conveying means; a discharging roller 113, disposed at the bottom of the reservoir 112, for discharging the toner which is temporarily reserved in the reservoir 112; and a tilt member 114, disposed below the discharging roller 113, the tilt member 114 having two slopes downwardly inclined from the center of the recovery toner container to the both ends in the longitudinal direction which is perpendicular to the sheet surface of FIG. 17. More specifically, the tilt member 114 is formed into a substantially strap shape, the center portion thereof in the longitudinal direction being bent to form two slopes 115, 116. Each of the slopes 115, 116 is provided with a plurality of through holes 117. The through holes 117 are formed in the respective slopes 115, 116 by punching in the vertical direction, in the condition that the tilt member 114 is placed in the position shown in FIGS. 17 and 18. The tilt angle θ7 formed between the horizontal surface and each of the slopes 115, 116 is selected in relation to the angle of repose of the toner. The angle of repose of the fresh toner is in the range from 30° to 60°, while the angle of repose of the recovery toner is in the range from 40° to 70°. In this embodiment of the invention, the tilt angle θ7 is 40°, for example. At both ends in the longitudinal direction of the tilt member 114, is provided projections 118, 119 which project upwardly in the direction perpendicular to the respective slopes 115, 116.

At the bottom of the toner hopper 102, is provided a pair of toner replenishing rollers 120 for replenishing unused and recovery toner to the developing unit 14. The toner replenishing rollers 120 are disposed in contact with each other, and the configuration thereof is similar to that of the fresh toner replenishing roller 26 and the recovery toner replenishing roller 27 shown in FIGS. 1 to 4. The toner replenishing rollers 120 are operable in cooperation with each other, and rotatably driven by toner replenishing roller drive means 121 which comprises an electric motor or the like. The operation of the toner replenishing roller drive means 121 is controlled by the control circuit 40 such that the revolutions or rotation time of each toner replenishing roller 120 is controlled.

The respective tilt angles θ5, θ6 of bottom portions 102*a*, 102*b* of the toner hopper 102 are selected in relation to the angles of repose of the fresh toner and recovery toner. That is to say, the bottom portion 102*a* facing only the fresh toner container 24 has a tilt angle θ5=40° with respect to the horizontal surface, while the bottom portion 102*b* lying across the fresh toner container 24 and the recovery toner container 25 has a tilt angle θ6=50° with respect to the horizontal surface. As a result of this, fresh toner and recovery toner can move on the bottom portions 102*a*, 102*b* without residing on the bottom portions 102*a*, 102*b*.

The discharging roller 113 is rotatably driven by discharging roller drive means 122 which comprises an electric motor or the like. The operation of the discharging roller drive means 122 is controlled by the control circuit 40 such that the revolutions or rotation time of the discharging roller 113 is controlled.

The recovery toner is supplied from the cleaning unit 16 to nearly the longitudinal center of the recovery toner container 25 via the conveying means 32, and temporarily contained in the reservoir 112. The toner contained in the reservoir 112 is discharged to nearly the longitudinal center of the recovery toner container 25 by rotational drive of the discharging roller 113. This recovery toner falls on an apex 123 of the tilt member 114, and then slides down on each of the slopes 115, 116 toward the respective projections 118, 119 while falling through the plurality of through holes 117, and thereby the recovery toner is deposited substantially uniformly in the longitudinal direction of the toner hopper 102 in the vicinity of the contacting portion between the bottom portion 102*b* of the toner hopper 102 on the recovery toner container 25 side and a lower end 111*a* of the toner counterflow preventing member 111. When the recovery toner thus deposited reaches to the amount so much as to displace the toner counterflow preventing member 111 to the fresh toner container 24 side, the recovery toner pushes the toner counterflow preventing member 111 to the fresh toner container 24, thereby flowing into the fresh toner container 24. When the amount of the recovery toner is decreased as a result of toner inflow to the fresh toner container, the toner counterflow preventing member 111 returns to its original position owing to the elasticity thereof. In this way, the recovery toner flows into the fresh toner container 24 from the recovery toner container 25 at the side of the lower edge 110*a* of the partition wall 110. The inflow recovery toner is supplied to the toner replenishing rollers 120 together with the fresh toner, and replenished to the developing unit 14 via a replenishing opening 124 provided on the developing unit 14 after being preliminarily mixed with each other at the contact portion between each toner replenishing roller 120. In this way, toner recycling is carried out.

Since the recovery toner flows into the fresh toner container 24 from the recovery toner container 25 at the lower edge 110*a* of the partition wall 110, the fresh toner and the recovery toner are securely mixed with each other, and thereafter the toner is replenished to the developing unit 14. As a result, it is possible to prevent abrupt deterioration of image quality which occurs when only the recovery toner is supplied to the developing unit 14. In addition, the recovery toner is securely utilized for image formation, so that it is possible to improve the utilizing factor of toner.

Further, since counterflow of the fresh toner into the recovery toner container 25 is prevented by means of the toner counterflow preventing member 111, it is possible to prevent the bottom of the recovery toner container 25 from being closed by the fresh toner and prevent a load for replenishing toner to the developing unit 14 from increasing.

Furthermore, since the recovery toner is not mixed with the fresh toner unless discharged via the toner counterflow preventing member 111, it is possible to avoid only one of the fresh toner and the recovery toner from being replenished to the developing unit 14. That is to say, since the fresh toner does not flow into the recovery toner container 25 to prevent the recovery toner from being discharged, it is possible to prevent that only the fresh toner is replenished to the developing unit 14 at first and thereafter the recovery toner is concentratedly replenished from the recovery toner container 25 to the developing unit 14 to thereby cause abrupt deterioration of the image quality.

Furthermore, since the toner counterflow preventing member 111 is made of a flexible elastic material and configured so as to be pushed and opened by the self weight of the recovery toner, and thereafter be returned to its original position due to elasticity thereof, it is possible to intercept the fresh toner container 24 and the recovery toner container 25, whereby it is possible to prevent the counterflow of the fresh toner into the recovery toner container 25. Furthermore, since the toner counterflow preventing member 111 is made of a material which lacks an affinity for the toner, it is possible to prevent toner from adhering to the toner counterflow preventing member 111 and prevent the toner counterflow preventing member 111 from reacting with the component of the toner to alter the quality thereof. As a result, it is also possible to avoid the quality of the toner counterflow preventing member 111 from being altered by the component of the toner because of changes with time. Therefore, it is possible to maintain the function of preventing the counterflow of toner for a long period of time.

Furthermore, since the capacity of the fresh toner container 24 is selected to be larger than that of the recovery toner container 25, it is possible to prevent the toner counterflow preventing member 111 from being kept pushed and opened by the recovery toner, as well as raise the ratio of fresh toner within the toner to be replenished to the developing unit 14.

The recovery toner is temporarily reserved in the reservoir 112 before being mixed with the fresh toner, and thereafter mixed with the fresh toner. Therefore, the recovery toner which has been heated in image forming can be reused after ample time, and can be reused in image forming after the quality of the recovery toner for image forming is enhanced by dissipating heat of the recovery toner during the ample time. Therefore, it is possible to avoid in advance that the recovery toner with lowered characteristics which is set aside for a long time forms a mass in the recovery toner container 25 and deteriorates the image quality when used in image forming.

Since the recovery toner flows into the fresh toner container 24 while being substantially uniformly deposited on the bottom portion 102*b* of the toner hopper 102 on the side of the recovery toner container 25 due to the tilt member 114, the recovery toner in the toner to be replenished to the developing unit 14 almost uniformly distributes in the longitudinal direction, and defects of images hardly appears even when the recovery toner with lowered characteristics is used. Therefore, it is possible to avoid deterioration of the image quality with a simple configuration. Furthermore, since the tilt angle θ7 of the slant surface of each slope 115, 116 of the tilt member 114 is selected in relation to the angle of repose of the recovery toner, the recovery toner can securely slide down on each slope without being depositing on the same. Furthermore, since the tilt member 114 is provided with the projections 118, 119 at both ends thereof, it is possible to prevent the recovery toner which slides down on each slope and reaches both the longitudinal edges from being localized and depositing on both the longitudinal edges of the bottom of the recovery toner container 25. Accordingly, the ratio of the recovery toner in the toner inside the developing unit 14 is to distribute almost uniformly along the longitudinal direction, with the result that it is possible to avoid, for example, the toner from scattering and the image from being temporarily blurred.

The toner replenished to the developing unit 14 is mixed within the developing unit 14, and the concentration thereof is detected by the T sensor 21. The ratio of the recovery toner in the toner replenished to the developing unit 14 is set at equal to or less than a ratio which can be detected by the T sensor 21, such as 30% or less.

Since the developing unit 14 is provided with the T sensor 21, it is possible to control the ratio of the fresh toner in the mixed toner to be replenished to the developing unit 14, and hence it is possible to suppress adverse effects resulting from the characteristics of the recovery toner which is deteriorated as being reused, thereby implementing the image forming apparatus 101 with high accuracy. From the viewpoint of the utilizing factor of toner, it is preferable to mix the recovery toner as much as possible so as to affect on the image quality. However, as the ratio of toner with deteriorated characteristics which is repeatedly used in the development operation, the T sensor 21 may come to output in an unstable manner to become incapable of following the change characteristics of the toner, and it may get difficult to control the concentration of the toner. Therefore, the recovery toner is mixed the most within a range which the T sensor 21 can recognize as being within a predetermined range of characteristics of toner, thereby eliminating the necessity of correcting the output of the T sensor 21.

As the volume of image formation is increased, the ratio of the recovery toner in the toner supplied to a electrostatic latent image becomes high, which may cause deterioration in image density and image quality. In view of this, the ratio of the fresh toner is increased with the increase of the volume of image formation to restrict adverse effects due to the toner characteristics which deteriorate depending on the number of reuse of the toner, whereby it is possible to realize image formation with high accuracy. More specifically, this is achieved, as same as the embodiments of the invention shown in FIGS. 1 to 15, by controlling operation of the toner replenishing roller 120 so that the ratio of the fresh toner in the toner supplied to the developing unit 14 becomes high, on the basis of the cumulative rotation time of the photoconductor drum 11 which is counted by the counting means 39. As for the control of operation of the toner replenishing roller 120, it is the same as the embodiments of the invention shown in FIGS. 5 to 15. Furthermore, as the volume of image formation is increased, the amount of the recovery toner recovered by the cleaning unit 16 increases. If all of the recovery toner thus recovered is conveyed to the recovery toner container, there is a possibility that the recovery toner overflows from the recovery toner container 25, which generates a malfunction such that an undesired pressure acts on the recovery toner and hence the quality of the recovery toner is deteriorated and the recovery toner permanently remains on the recovery toner container 25 due to agglomeration of the recovery toner. For the purpose of solving these problems, the control circuit 40 controls the operations of the screw drive means 38, 106, on the basis of the counting result of the counting means 39, to thereby adjust the amount of the recovery toner to be conveyed by the conveying means 32 and the amount of the waste toner to be conveyed by the waste toner conveying means 104.

More specifically, each of the screw drive means 38, 106 is controlled by the control circuit 40 such that as the counting result of the counting means 39 is increased, the amount of the waste toner is increased and the amount of the recovery toner is decreased. As described above, on the basis of the counting result of the counting means 39, the amount of the toner to be conveyed to the recovery toner container 25 and the amount of the toner to be conveyed to the waste toner container 103 are regulated within the counting means 39, so that it is possible to avoid the overflow of the recovery toner container 25 and suppress adverse effects of the characteristics of deteriorated toner by automatically discarding the recovery toner which is deteriorated by repeated uses and thus cannot be reused anymore, thereby implementing the image forming apparatus 101 with high accuracy. Furthermore, since the ratio of the deteriorated toner contained in the recovery toner gradually increases as the volume of image formation increases, it is possible to stabilize the image quality by increasing the amount of the waste toner and decreasing the amount of the toner to be conveyed to the recovery toner container.

Furthermore, in controlling the ratio of the fresh toner in the toner to be replenished to the developing unit 14, it is preferable that the amount of the recovery toner discharged by the discharging means 31 in the cleaning unit 16, the amount of the recovery toner conveyed by the conveying means 32 and the amount of the toner replenished by the toner replenishing roller 120 are controlled in good balance because there are close relationships among these amounts. That is to say, when the amount of the toner to be replenished by the toner replenishing roller 120 is less than the amount of the recovery toner conveyed by the conveying means 32, an overflow will occur in the reservoir 112. Similarly, when the amount of the recovery toner conveyed by the conveying means 32 is less than the amount of the recovery toner discharged by the discharging means 31, the recovery toner remains on the conveying means 32, bringing a problem such that agglomeration of the recovery toner and the load to the conveying means 32 are increased due to pressure between toner particles of the recovery toner. For the purpose of solving these problems, the amount of the recovery toner discharged by the discharging means 31, the amount of the recovery toner conveyed by the conveying means 32 and the amount of the toner to be replenished by the toner replenishing roller 120 are balanced with each other, and excess recovery toner is conveyed by the waste toner conveying means 104, to be contained in the waste toner hopper 103.

Since the projections 117, 118 of the slopes 115, 116 are disposed so as to be perpendicular to the respective slopes 115, 116, even when the recovery toner reaches to the projections 117, 118, the tilt angle of each projection 118, 119 with respect to the horizontal surface is larger than the angle of repose of the recovery toner, so that it is possible to prevent the toner from remaining in the vicinities of the projections 118, 119.

Figure 19A:
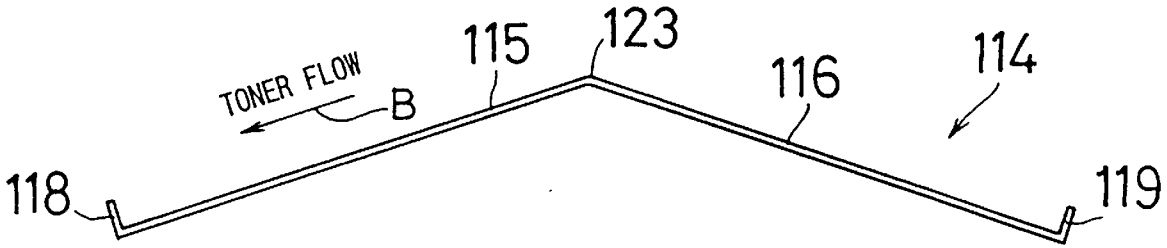
FIGS. 19A and 19B are views showing a simplified configuration of a tilt member.
Figure 19B:
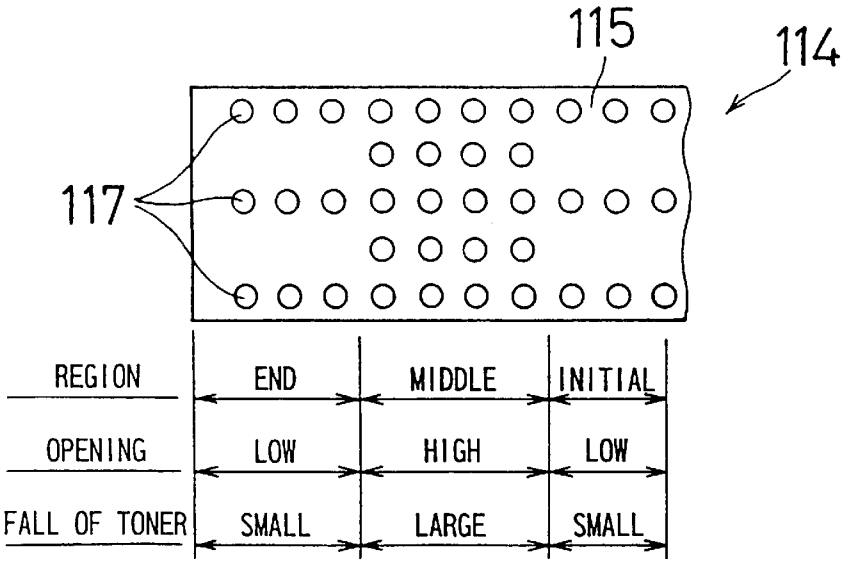

FIGS. 19A and 19B are views showing a simplified configuration of the tilt member 114. FIG. 19A is a front view of the tilt member 114, and FIG. 19B is a bottom view of one of the slopes 115. In FIG. 19B, the other of the slopes 116 is the same in configuration as the slope 115, and illustration thereof will be omitted. The slope 115 has regions in the toner sliding direction B from the apex 123 to the projection 118, the regions having different opening ratios. That is to say, the opening ratio of the region near the apex 123 and the region near the projection 118 is smaller than that of the region near the center portion of the slope 115. As a result of this, the amounts of fall of toner in the region near the apex 123 and in the region near the projection 118 becomes small, while the amount of fall of toner in the region near the center portion becomes large. In this way, it is possible to control the amount of fall of the recovery toner and supply the recovery toner almost uniformly in the longitudinal direction of the toner replenishing roller 120.

Figure 20A:
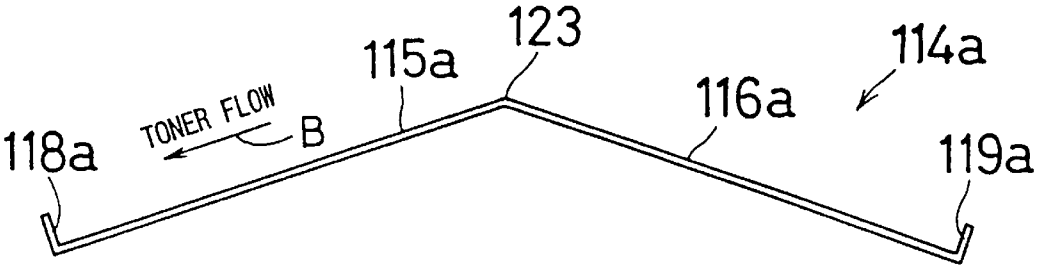
FIGS. 20A and 20B are views showing a simplified configuration of a tilt member provided to the toner replenishing apparatus of the yet still further embodiment of the invention.
Figure 20B:
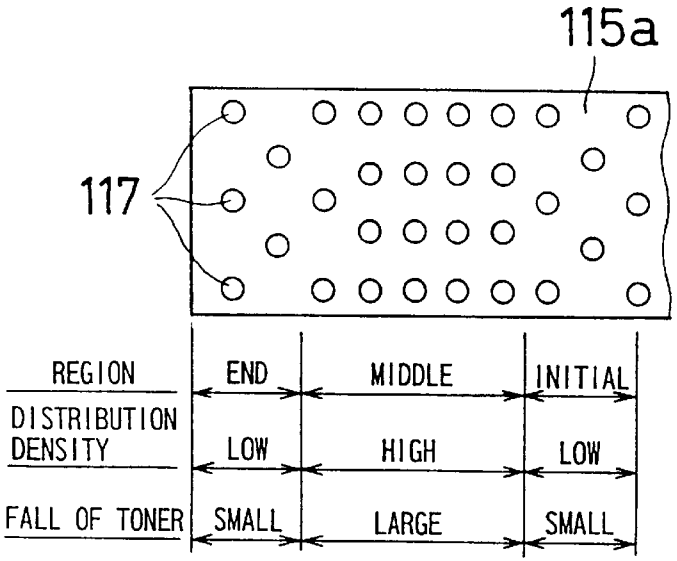

FIGS. 20A and 20B are views showing a simplified configuration of a tilt member 114*a* provided to the toner replenishing apparatus of the yet still further embodiment of the invention. FIG. 20A is a front view of the tilt member 114*a* and FIG. 20B is a bottom view of one of the slopes 115*a*. The other of the slopes 116*a* is the same in configuration as the slope 115*a*, and illustration thereof will be omitted. The tilt member 114*a* is similar in configuration to the tilt member 114 as shown in FIGS. 19A and 19B, and it is worthy of remark that distribution density of the through holes 117 differs from region to region in the sliding direction B. That is to say, in the regions near the apex 123 and near the projections 118*a* and 119*a*, the through holes 117 are staggered and thus the distribution density is low, while in the region near the center portion, the through holes 117 are arranged in a matrix shape so that the distribution density is high. As a result of this, the amount of fall of the recovery toner becomes small in the region near the apex 123 and in the region near the projection 118*a*, and the amount of fall of the recovery toner in the region near the center portion becomes large. Also, in this manner, it is possible to obtain the same effect as the tilt member 114 shown in FIGS. 19A and 19B.

Figure 21:
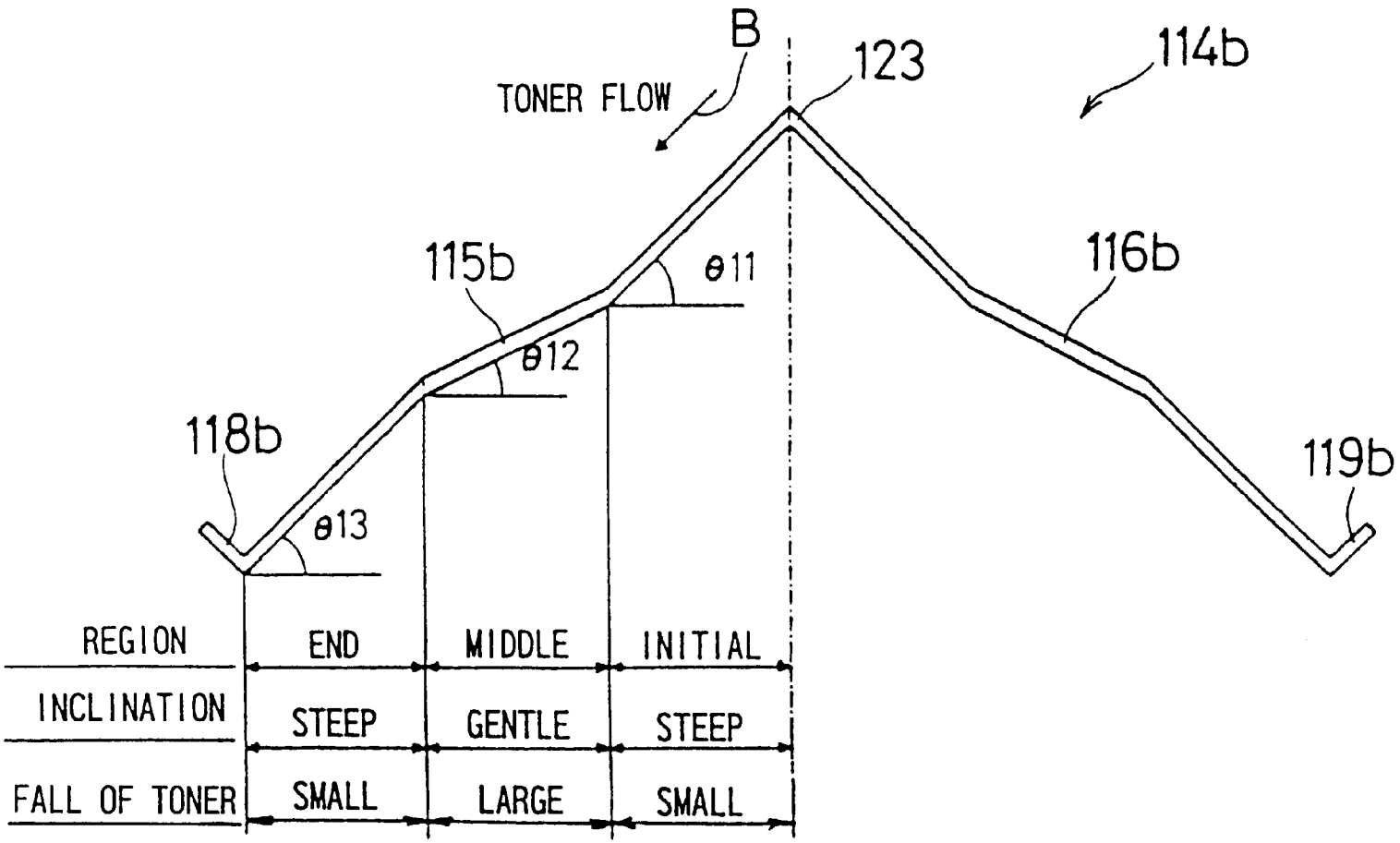
FIG. 21 is a front view showing a simplified configuration of a tilt member provided to the toner replenishing apparatus of the yet still further embodiment of the invention.

FIG. 21 is a front view showing a simplified configuration of a tilt member 114*b* provided to the toner replenishing apparatus of the yet still further embodiment of the invention. Since the slope 116*b* is similar in configuration to the slope 115*b*, illustration thereof will be omitted. The tilt member 114*b* is similar in configuration to the tilt members 114, 114*a* as shown in FIGS. 19A and 19B, and FIGS. 20A and 20B, and it is worthy of remark that the shape and distribution density of the through holes 117 disposed in each slope 115*b*, 116*b* are uniform along all regions, while the tilt angle with respect to the horizontal surface differs from region to region in the sliding direction B. That is to say, the tilt angles θ11, θ13 in the regions near the apex 123 and the projection 118b are set to be larger than the tilt angle θ12 in the region near the center portion. Element 119*b* is a projection. As a result of this, the moving speed of the recovery toner differs from region to region, with the result that the amount of fall of the recovery toner in the regions near the apex 123 and the projection 118*b* becomes smaller and in the region near the center portion becomes larger. Also, with this configuration, it is possible to obtain a similar effect to the tilt members 114, 114*a* as shown in FIGS. 19A and 19B and FIGS. 20A and 20B. Incidentally, the tilt angles θ11, θ13 are 40 degrees, for example, while the tilt angle θ12 is 20 degrees, for example.

Figure 22:
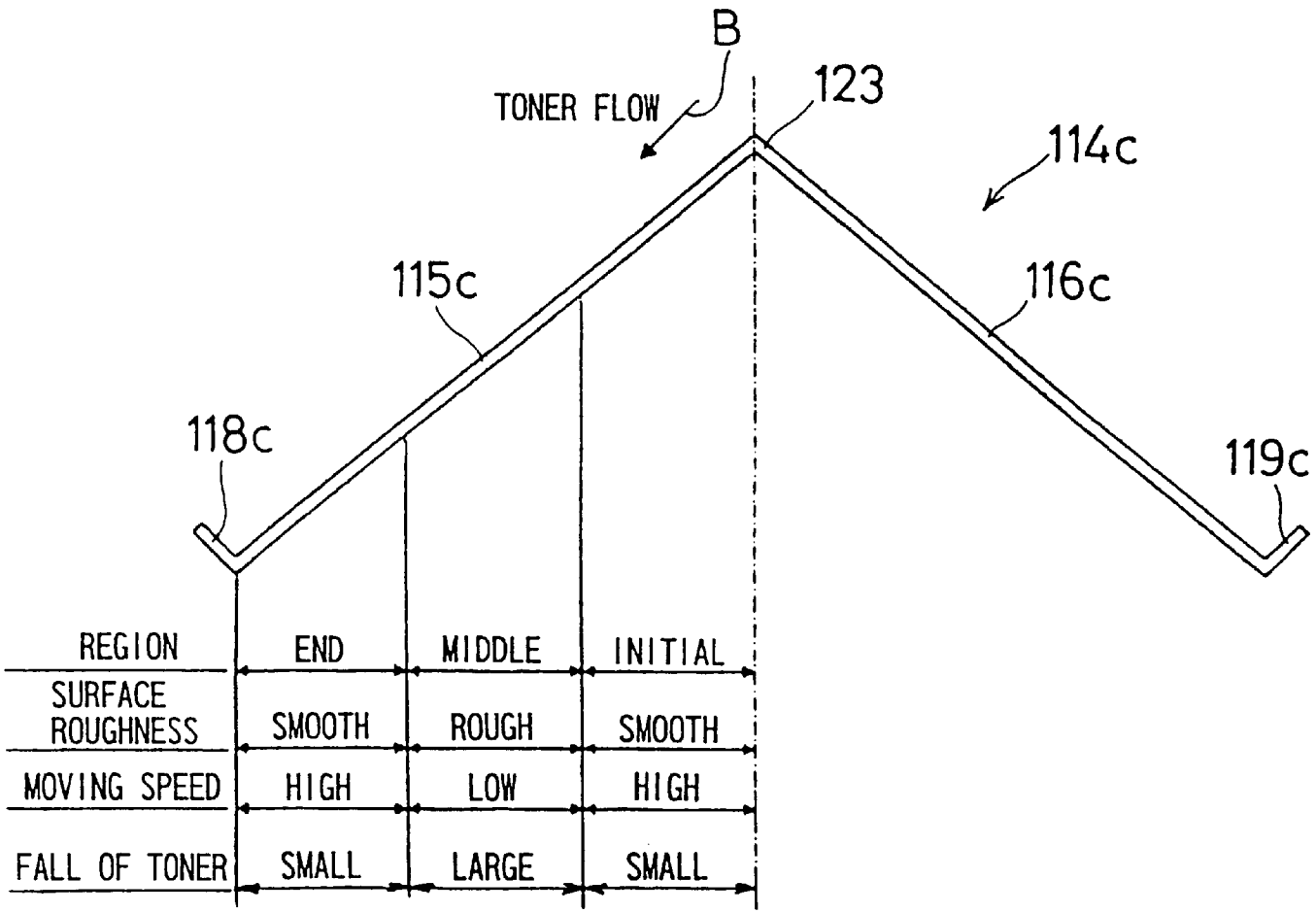
FIG. 22 is a front view showing a simplified configuration of a tilt member provided to the toner replenishing apparatus of the yet still further embodiment of the invention.

FIG. 22 is a front view showing a simplified configuration of a tilt member 114*c* provided to the toner replenishing apparatus of the yet still further embodiment of the invention. The other slope 116*c* is similar in configuration to the one slope 115*c*, and hence illustration thereof will be omitted. The tilt member 114*c* is similar in configuration to the tilt members 114, 114*a* and 114*b* as shown in FIGS. 19A to 21, and it is worthy of remark that the shape and distribution density of the through holes 117 provided in each of the slopes 115*c*, 116*c* are uniform for all regions, but surface roughness of each of the slope 115*c*, 116*c* differs from region to region in the sliding direction B. The surface roughness is small in the regions near the apex 123 and near the projection 118*c*, so that the surfaces of these regions are smooth. Element 119*c* is also a projection. Whereas, the surface roughness is small in the region near the center portion, so that the surface of this region is rough. As a result of this, moving speed of the recovery toner differs from region to region in the sliding direction B such that the moving speed is larger in the regions near the apex 123 and the projection 118*c* and smaller in the region near the center portion. Therefore, the amount of fall of the recovery toner is smaller in the regions near the apex 123 and the projection 118*c*, while the amount of fall of the recovery toner is larger in the region near the center portion. Also, with this configuration, it is possible to obtain a similar effect to the tilt members 114, 114*a*, 114*b* as shown in FIGS. 19 to 21.

Figure 23A:
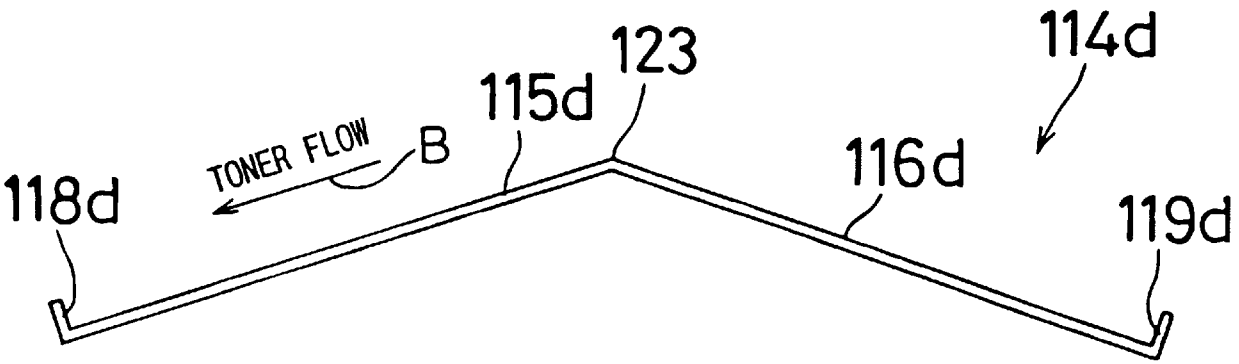
FIGS. 23A and 23B are views showing a simplified configuration of a tilt member provided to the toner replenishing apparatus of the yet still further embodiment of the invention.
Figure 23B:
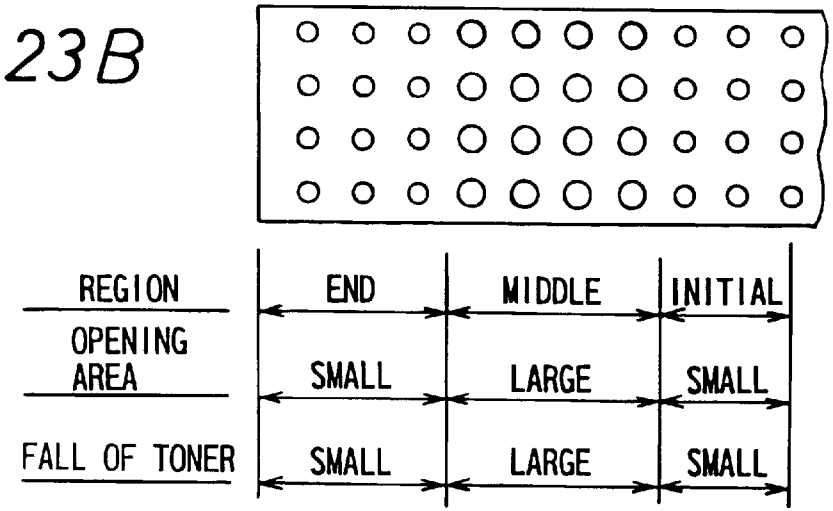

FIGS. 23A and 23B are views showing a simplified configuration of a tilt member 114*d* provided to the toner replenishing apparatus of the yet still further embodiment of the invention. FIG. 23A is a front view of the tilt member 114*d*, and FIG. 23B is a bottom view of one slope 115*d*. The slope 116*d* is similar in configuration to the slope 115*d*, and hence illustration thereof will be omitted. The tilt member 114*d* is similar in configuration to the tilt members 114, 114*a*, 114*b* and 114*c* as shown in FIGS. 19B to 22, and it is worthy of remark that the opening area of the through holes 117 differs from region to region in the sliding direction B. The opening areas of through holes 117 in the regions near the apex 123 and near a projection 118*d* are set to be smaller than the opening area of through holes 117 in the region near the center portion. As a result of this, the amount of fall of the recovery toner becomes small in the regions near the apex 123 and near the projection 118*d* and large in the region near the center portion. Also, in this manner, it is possible to obtain the same effect as the tilt members 114, 114*a*, 114*b*, 114*c* shown in FIGS. 19B to 22B. Element 119*d* is another projection.

Figure 24:
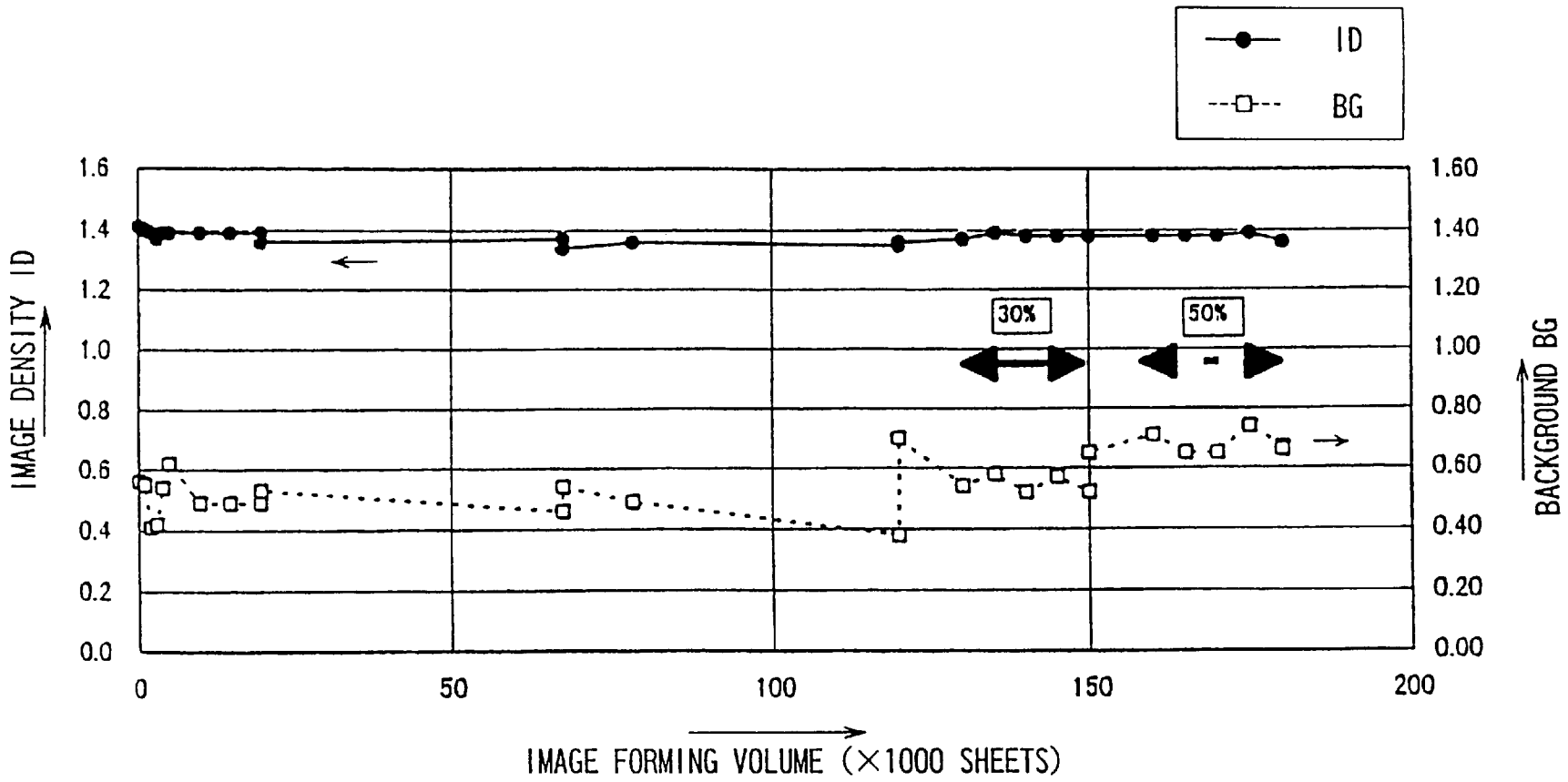
FIG. 24 is a graph showing the changing states of an image density ID and a background density BG, i.e., a fog level with respect to the image forming apparatuses shown in FIGS. 1 to 23B.

FIG. 24 is a graph showing changing states of image density ID and background density BG, i.e. fog level, with respect to the image forming apparatuses 2, 51, 61, 71, 82, 91, 101 as shown in FIGS. 1 to 23B. The horizontal axis denotes the volume of image formation, the left vertical axis denotes the image density ID and the right vertical axis denotes the background density BG, i.e. fog level. Until the volume of image formation reaches 130,000 sheets, image formation is carried out by using only fresh toner. From 130,000th sheets to 150,000th sheets, image formation is carried out by using recovery toner in a ratio of 30% by weight. As a comparison, from 160,000th to 180,000th sheets, image formation is carried out by using recovery toner in a ratio of 50% by weight. It can be seen that the toner characteristics change in a stable manner with the increase of volume of image formation when the ratio of the recovery toner is 30%. In contrast, it can be seen that when the ratio of the recovery toner is 50%, the fog level is increased so that surface contamination is signified and the image quality is deteriorated, though the image density ID remains stable.

Figure 25:
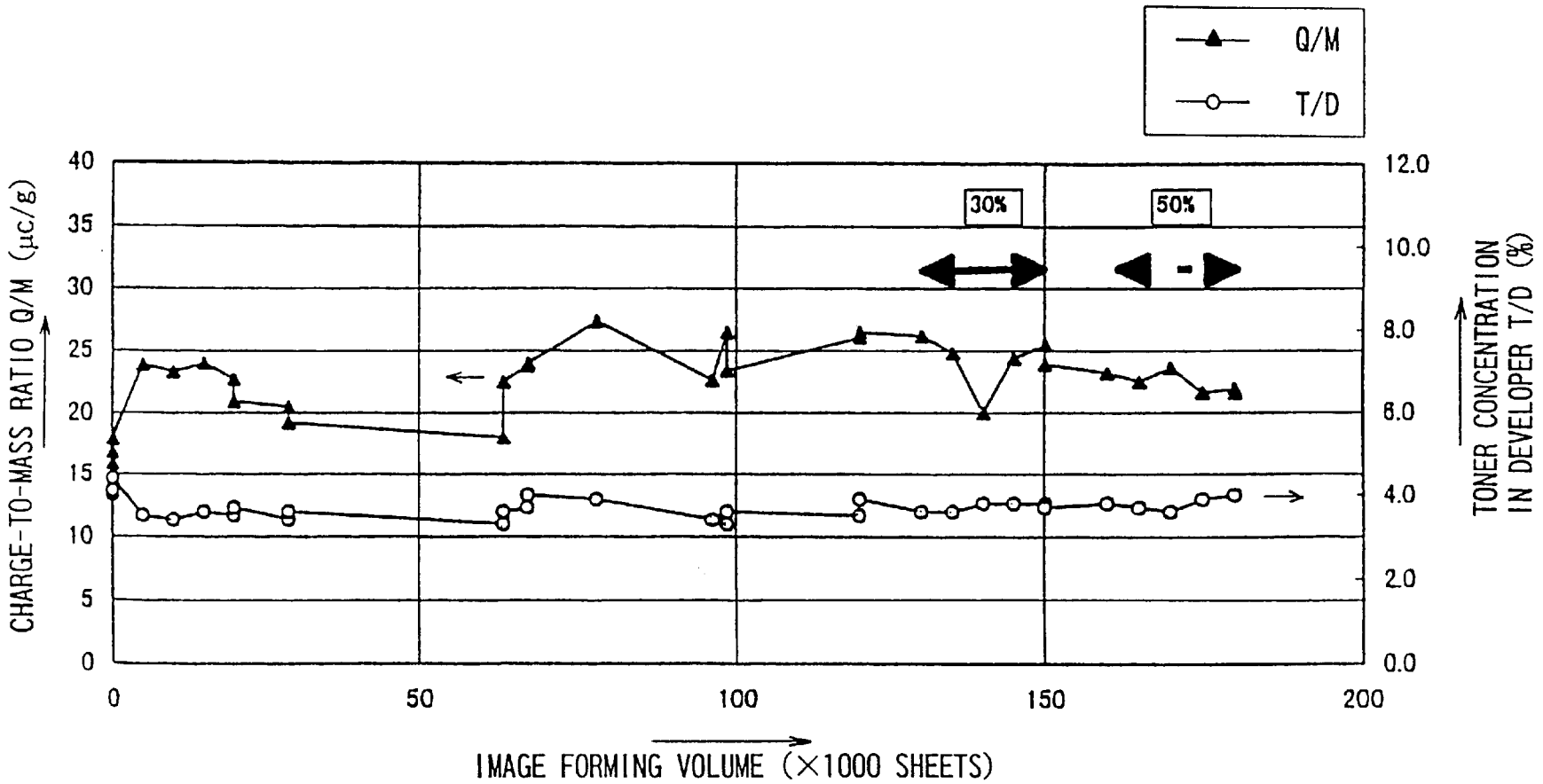
FIG. 25 is a graph showing the changing states of a charge amount of toner Q/M and a toner concentration in the developer T/D with respect to the image forming apparatuses shown in FIGS. 1 to 23B.

FIG. 25 shows a graph showing changing states of charge-to-mass ratio Q/M and toner concentration in the developer T/D with respect to the image forming apparatus 2, 51, 61, 71, 82, 91 and 101 shown in FIGS. 1 to 23B. The horizontal axis denotes volume of image formation, the left vertical axis denotes charge-to-mass ratio Q/M and the right vertical axis toner concentration in the developer T/D. When the ratio of the recovery toner is 30%, both the charge-to-mass ratio Q/M and the toner concentration in the developer T/D change substantially in a stable manner as the volume of image formation increases. However, it can be seen that when the ratio of the recovery toner is 50%, the charge-to-mass ratio Q/M decreases as the volume of image formation increases even though the toner concentration in the developer T/D increases. Accordingly, the fog level is increased to cause the surface contamination to be signified and the image quality to be deteriorated.

Figure 26:
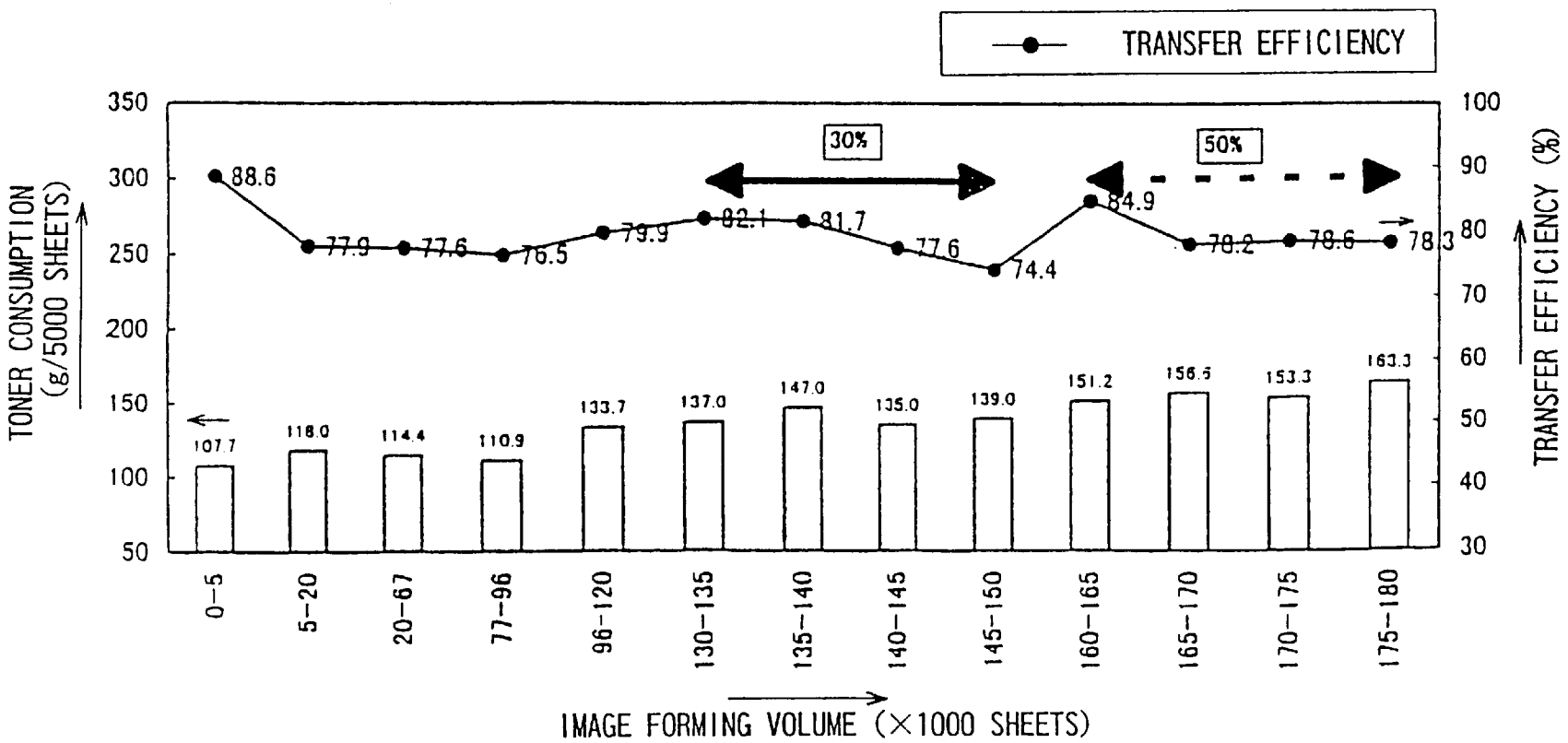
FIG. 26 is a graph showing relationships of toner consumption and transfer efficiency to image forming volume of the image forming apparatuses shown in FIGS. 1 to 23B.

FIG. 26 is a graph showing relationships of toner consumption and transfer efficiency to image forming volume of the image forming apparatuses 2, 51, 61, 71, 82, 91, 101 shown in FIGS. 1 to 23B. The horizontal axis denotes volume of image formation, the left vertical axis denotes toner consumption, and the right vertical axis transfer efficiency. Herein, "transfer efficiency" represents a ratio between the amount of toner supplied to an electrostatic latent image and the amount of toner transferred on a sheet of paper. As shown in FIG. 26, the transfer efficiency changes almost constantly regardless of whether the ratio of the recovery toner is 30% or 50%, however the toner consumption is increased much more when the ratio of the recovery toner is 50%.

In FIGS. 24 to 26, at the ratio of the recovery toner of 50%, the image quality is more readily deteriorated, the toner consumption becomes high, and thus the cost efficiency is poor as compared with the case where the ratio of the recovery toner is 30%. Therefore, by setting the ratio of the recovery toner at 30%, it is possible to prevent the image quality from being deteriorated and to improve the cost efficiency.

In the embodiments of the invention as shown in FIGS. 1 to 26, the counting means 39 counts the cumulative rotation time of the photoconductor drum 11. Alternatively, the counting means 39 may count the cumulative rotation number or the volume of image formation of the photoconductor drum 11. Also in such a manner, it is possible to obtain the same effect as the case where the cumulative rotation time of the photoconductor drum 11 is counted. Furthermore, by counting either the cumulative rotation time or the cumulative rotation number of the photoconductor drum 11, it is possible to consider the cumulative sum of time in which the toner is agitated by the former rotations or the like regardless of differences of time in image formation due to differences in paper size and of the image forming operation, as compared with the case where the actual volume of image formation is counted. As a result of this, it is possible to control the ratio between the fresh toner and the recovery toner with high accuracy.

In the embodiments of the invention as shown in FIGS. 16 to 23B, the toner counterflow preventing member 111 is formed of a PET plate. Alternatively, the toner counterflow preventing member 111 may be formed of a thin plate made of ABS resin, alloy of aluminum, stainless steel, phosphor bronze, brass or the like so far as it is an elastic material having an affinity for toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means, to the recovery toner container; and toner replenishing means for replenishing fresh toner supplied from the fresh toner container and recovery toner supplied from the recovery toner container, to the developing means, wherein when an amount of the recovery toner contained in the recovery toner container exceeds a predetermined capacity of the recovery toner container, recovery toner is routed to the fresh toner container instead of the recovery toner container.

2. The toner replenishing apparatus of claim 1, wherein the recovery toner exceeding the predetermined capacity of the recovery toner container flows into the fresh toner container over an upper edge of a partition wall dividing the fresh toner container and the recovery toner container, to be contained therein.

3. The toner replenishing apparatus of claim 1, wherein the conveying means includes first conveying means for conveying the recovery toner recovered by the recovering means to the recovery toner container, and second conveying means for conveying the recovery toner conveyed by the first conveying means to the fresh toner container, the second conveying means extending between the recovery toner container and the fresh toner container, the recovery toner container is provided with capacity excess detecting means for detecting that an amount of the recovery toner contained in the recovery toner container exceeds the predetermined capacity; and when it is detected by the capacity excess detecting means that the amount of the recovery toner exceeds the predetermined capacity, the recovery toner conveyed by the first conveying means is conveyed to the fresh toner container via the second conveying means.

4. A toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein the fresh toner container and the recovery toner container are partitioned by a partition wall, at a lower edge of which the recovery toner flows into the fresh toner container from the recovery toner container.

5. The toner replenishing apparatus of claim 4, wherein a toner counterflow preventing member for preventing counterflow of the fresh toner into the recovery toner container is provided at the lower edge of the partition wall.

6. The toner replenishing apparatus of claim 5, wherein the toner counterflow preventing member is made of a flexible elastic material.

7. The toner replenishing apparatus of claim 4, wherein the recovery toner container is provided with a reservoir for temporarily reserving the recovery toner.

8. A toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein when an amount of the recovery toner contained in the recovery toner container exceeds a predetermined capacity of the recovery toner container, recovery toner is routed to the fresh toner container instead of the recovery toner container;

the toner replenishing means is disposed at a bottom of a toner container which is integrally formed by the fresh toner container and the recovery toner; and at the bottom of the toner container, a plurality of first toner supply orifices, open toward the toner replenishing means to supply the fresh toner to the toner replenishing means, and a plurality of second toner supply orifices, open toward the toner replenishing means to supply the recovery toner to the toner replenishing means, are alternately arranged.

9. The toner replenishing apparatus of claim 8, wherein an opening area of each first toner supply orifice is larger than an opening area of each second toner supply orifice.

10. The toner replenishing apparatus of claim 8, wherein with respect to an amount of toner to be replenished to the developing means by the toner replenishing means, an amount of the toner replenished by the toner replenishing means in regions corresponding to the respective first supply orifices is more than an amount of the toner replenished by the toner replenishing means in regions corresponding to the respective second toner supply orifices.

11. A toner replenishing apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein the fresh toner container and the recovery toner container are partitioned by a partition wall, at a lower edge of which the recovery toner flows into the fresh toner container from the recovery toner container;

the recovery toner is supplied to nearly the center of the recovery toner container;

the recovery toner container, which is of a longitudinal shape, is provided with a tilt member having two slopes, the slopes being inclined downwardly from the center of the recovery toner container to both ends in the longitudinal direction; and the tilt member is provided with a plurality of through holes.

12. An image forming apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner contained in the fresh toner container and recovery toner contained in the recovery toner container, to the developing means at a predetermined ratio, wherein when an amount of the recovery toner contained in the recovery toner container exceeds a predetermined capacity, recovery toner is routed to the fresh toner container instead of the recovery toner container; and an operation of the conveying means is controlled so as to regulate an amount of the recovery toner which is recovered by the recovering means.

13. An image forming apparatus comprising:

developing means for supplying toner to an electrostatic latent image formed on a cylindrical photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container;

toner replenishing means for replenishing fresh toner contained in the fresh toner container and recovery toner contained in the recovery toner container, to the developing means at a predetermined ratio; and counting means for counting any one of a cumulative rotation time of the photoconductor, a cumulative number of rotations of the photoconductor and a volume of image formation, wherein when an amount of the recovery toner contained in the recovery toner container exceeds a predetermined capacity, recovery toner is routed to the fresh toner container instead of the recovery toner container; and on the basis of a counting result of the counting means, operations of the conveying means and the toner replenishing means are controlled so as to change an amount of the toner to be replenished from the toner replenishing means to the developing means.

14. An image forming apparatus comprising:

developing means for supplying toner to an electrostatic latent image formed on a cylindrical photoconductor and developing the electrostatic latent image;

toner concentration detecting means for detecting a concentration of toner in the developing means;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container;

toner replenishing means for replenishing fresh toner contained in the fresh toner container and recovery toner contained in the recovery toner container, to the developing means at a predetermined ratio; and counting means for counting any one of a cumulative rotation time of the photoconductor, a cumulative number of rotations of the photoconductor and a volume of image formation, wherein when an amount of the recovery toner contained in the recovery toner container exceeds a predetermined capacity, recovery toner is routed to the fresh toner container instead of the recovery toner container; and when toner is replenished on the basis of an output of the toner concentration detecting means, operations of the conveying means and the toner replenishing means are controlled so that an amount of toner to be replenished from the toner replenishing means to the developing means is relatively increased as compared with an amount of toner supplied from the conveying means to the toner replenishing means, in accordance with a counting result of the counting means.

15. An image forming apparatus comprising:

developing means for supplying toner to an electrostatic latent image formed on a photoconductor and developing the electrostatic latent image;

a fresh toner container for containing fresh toner;

recovering means for recovering toner residue on the photoconductor;

a recovery toner container for containing recovery toner which is recovered by the recovering means;

conveying means for conveying the recovery toner which is recovered by the recovering means to the recovery toner container; and toner replenishing means for replenishing fresh toner supplied from the fresh toner container and recovery toner supplied from the recovery toner container, to the developing means, wherein the fresh toner container and the recovery toner container are partitioned by a partition wall, at a lower edge of which the recovery toner flows into the fresh toner container from the recovery toner container;

the recovery toner is supplied to nearly the center of the recovery toner container;

the recovery toner container, which is of a longitudinal shape, is provided with a tilt member having two slopes, the slopes being inclined downwardly from the center of the recovery toner container to both edges in the longitudinal direction;

the tilt member is provided with a plurality of through holes;

the developing means is provided with toner concentration detecting means for detecting a concentration of toner inside thereof; and a ratio of recovery toner in the toner to be replenished to the developing means is set to be equal to or less than a ratio which can be detected by the toner concentration detecting means.

16. An image forming apparatus comprising:

developing means for supplying toner to an electrostatic latent image formed on a cylindrical photoconductor and developing the electrostatic latent image;

a fresh toner container for containing fresh toner;

recovering means for recovering toner residue on the photoconductor;

a recovery toner container for containing recovery toner which is recovered by the recovering means;

recovery toner conveying means for conveying the recovery toner which is recovered by the recovering means, to the recovery toner container;

waste toner conveying means for conveying recovery toner to a waste toner container in which the recovery toner which is recovered by the recovering means is to be discarded and contained;

toner replenishing means for replenishing fresh toner supplied from the fresh toner container and recovery toner supplied from the recovery toner container, to the developing means; and counting means for counting any one of a cumulative rotation time of the photoconductor, a cumulative number of rotations of the photoconductor and a volume of image formation, wherein on the basis of a counting result of the counting means, operations of the recovery toner conveying means and the waste toner conveying means are controlled so as to regulate an amount of toner to be conveyed to the recovery toner container and an amount of toner to be conveyed to the waste toner container.

* * * * *